United States Patent [19]

Junginger et al.

[11] 4,125,907

[45] Nov. 21, 1978

[54] TRANSFER APPARATUS FOR THE TRANSFER OF RECUMBENT PATIENTS, PARTICULARLY IN HOSPITALS

[75] Inventors: Klaus M. Junginger; Hans-Ulrich Jung, both of Rastatt, Fed. Rep. of Germany

[73] Assignee: Stierlen-Maquet AG, Rastatt, Fed. Rep. of Germany

[21] Appl. No.: 805,462

[22] Filed: Jun. 10, 1977

[30] Foreign Application Priority Data

Jun. 14, 1976 [DE] Fed. Rep. of Germany ..... 2626638
Jun. 14, 1976 [DE] Fed. Rep. of Germany ..... 7618858

[51] Int. Cl.[2] ..... A61G 1/02; E06B 7/00
[52] U.S. Cl. ..... 5/81 B; 5/86
[58] Field of Search ..... 5/81 R–86 C; 198/202, 203

[56] References Cited

U.S. PATENT DOCUMENTS

| | | | |
|---|---|---|---|
| 3,493,979 | 2/1970 | Koll et al. | 5/81 C |
| 3,765,037 | 10/1973 | Dunkin | 5/81 C |
| 3,829,915 | 8/1974 | Dunkin | 5/81 C |
| 3,883,991 | 5/1975 | Adelhed | 5/81 R |
| 3,947,902 | 4/1975 | Conde et al. | 5/81 R |

*Primary Examiner*—Casmir A. Nunberg
*Attorney, Agent, or Firm*—Toren, McGeady and Stanger

[57] ABSTRACT

A device for transferring recumbent hospital patients from one location to another is constructed with a platform assembly mounted on a support member to be moveable within a horizontal transfer plane between two end positions equidistantly located on opposite sides of the support member. The platform assembly includes a pair of superposed rectangular separator plates each having a conveyor apron trained thereabout. Drive means are provided for shifting the platform assembly between its end positions within the horizontal transfer plane and also for selectively driving the conveyor aprons. The separator plates have attached thereto lateral check members extending along the sides of the platform assembly in directions parallel to the directions of movement of the assembly. Guide devices are mounted on opposite sides of the support member and arranged in engagement with the lateral cheek members of the platform assembly in order to guide the assembly for shifting movement within the horizontal transfer plane. The guide members and the lateral cheek members are constructed to enable movement of the platform assembly within the horizontal transfer plane between the two opposed end positions of movement which are located generally equidistantly on opposite sides of the main support member so that the horizontal transfer plane is defined to extend generally symmetrically relative to the support member. The support member is formed with a width dimension taken parallel to the direction of movement of the platform assembly which is less than one-half, and preferably within the range between one-third and one-sixth, of the width dimension of the platform assembly taken in the direction parallel to the direction of movement of the assembly.

30 Claims, 22 Drawing Figures

TRANSFER APPARATUS FOR THE TRANSFER OF RECUMBENT PATIENTS, PARTICULARLY IN HOSPITALS

BACKGROUND OF THE INVENTION

The present invention relates generally to transfer apparatus, and more particularly to transfer apparatus useful in hospitals for transferring recumbent patients between one location and another.

Generally, the invention relates to a structure which includes a base or support member having a horizontally disposed platform assembly mounted thereover for appropriate movement in the transfer of recumbent patients.

DISCUSSION OF THE PRIOR ART

One device of the type to which the invention relates is known from U.S. Pat. No. 3,493,979.

There it is disclosed that the support is of the same width as the platform — seen in the running sense of the aprons — and the platform can be moved away from one end position where it rests on the upper surface of the support, sideways into one other end position jutting out beyond the support where only the longitudinal rim of the platform — then located at the rear in relation to the direction into which the platform moves — rests upon said support. In this end position the platform must necessarily touch upon the surface of a bed, a stretcher or the like, or else it would collapse and cause damage. As soon as the patient is recumbent upon the platform, the latter must be moved back above the surface of the support before said support, which is arranged on a chassis, can be set in motion once again. A transfer of a patient between beds in a parallel arrangement cannot be effected because it is impossible to bring the transfer apparatus between the beds, to pick him up on one side of the support by means of the platform, to transfer him to the other side of the support, and to unload the patient there. After loading the patient, the apparatus must be turned which frequently is impossible within the space available between beds, greatly impeding the operation of the apparatus.

A further disadvantage of the known transfer apparatus used in hospitals residues in the fact that the aprons may be disinfected only with great difficulty. It is true that the conveyor apron which carries the patient may be rotated while the platform is idle but this does not apply to the lower apron, the latter being driven by the driving mechanism utilized to move the platform, so that the carrying run of the lower apron running between the plates of the platform cannot be disinfected and mutual contamination may take place.

In another known transfer apparatus of a similar design (DT-OS No. 2 317 111) the platform is guided within the support along its rear edge only and it is movable beyond its longitudinal side, so that the same difficulties in handling it occur, as have just been described for the above transfer apparatus. In a modified embodiment the motion of the platform is coupled with the drive of the conveyor apron, but here too a rotation of the lower apron is impossible while the platform is idle since the lower apron is attached to the support at one point of its circumference. In addition, the conveyor apron in this embodiment is carried inside the support in a reserve loop which can be shortened whenever the platform is moved, which results in a conveyor apron of great length, making its disinfecting difficult.

An additional transfer apparatus for the transfer of recumbent patients is known (DT-AS 1 260 629) where a plate with a concave upper surface is taken through a support which has driving means to move said plate and where this support has a width which is about one fourth of the width of the plate in a horizontal plane tangential to the direction of the motion of the plate. While moving through the support, this plate is seized consecutively along its entire width by guide rollers arranged inside the support. In one end position the plate extends from the rear side of the support almost vertically upwards while in its extended position, which is the position in which it is used, it extends outward from the longitudinal front side of the support. A transfer of a patient onto the support is impossible.

In the aforementioned transfer apparatus the plate is covered by an apron in the area which extends frontally from the support and beneath the plate it is provided with a plate segment movable in conjunction with the plate and covered by a lower apron. During the motion of the plate and the lower plate segment into their operating position both aprons are unwound from a storage reel located inside the support and they run through the crevice between the plate and the lower plate segment towards their longitudinal front edges. When the plate is returned to its nearly vertical end position, the aprons are wound around the reel once again. This makes it very difficult to disinfect these aprons after their use; the plate must first be brought into its operating position and the disinfecting device be guided across the upper surface of the plate covered by the upper apron, and across the underside of the lower apron. It is possible that bacteria accummulate inside the support and that they contaminate those apron sections of the wound wheels extending between the longitudinal front edges of the plate and the lower plate segment on the one, and the storage reel on the other hand, whenever they are in the operating position, so that disinfected aprons, when re-wound, may be contaminated once again by the bacteria present on the storage reel.

A known transfer apparatus for the transfer of recumbent patients in hospitals (DT-OS 2 129 361) provides a single plate which is guided along the frontal sides of the support extending upwards along the longitudinal sides of this support and parallel to the direction into which the support moves, the width of said support as seen in the direction of its motion, being considerably less than half of the width of the plate, where, depending upon the position of the plate, optional segments are guided along and by the support's frontal edges, and the plate is movable into end positions very nearly symmetrical to the support. In one of the endpositions of the plate which is its operational position, a belt-like cover is slung from a carrier frame located above the support and the plate around one longitudinal edge of the plate to that plate's underside. In order for the plate to move into its opposite end position, the cover is wrapped around a winding device contained inside the support. Inasmuch as the recumbent patient cannot be moved across the carrier frame arranged above the support, he can be loaded or unloaded only on one and the same side of the transfer apparatus so that it is again impossible to transfer him from one surface onto another one parallel thereto without having to turn the apparatus. Whenever the plate is pushed beneath a patient, between him and the supporting surface, the cover of the underside of the plate runs faster than the plate itself, so that there is danger that the sheet on the surface on which the patient is reclined may be carried along towards the longitudinal front edge of the plate and there to form folds. Finally, it is difficult to disinfect the cover, which cover is possibly contaminated again when the winding device has would it into a spool in different layers. The cover, therefore, must be exchanged after each separate use or after repeated uses, which requires considerable effort in the servicing of the apparatus.

SUMMARY OF THE INVENTION

It is the purpose of the invention to improve the operation of a transfer apparatus for the transfer of recumbent patients during the transfer of such patients as well as during the disinfecting procedure required before use.

In the transfer appartus of the invention the support takes up little space because its width is small, facilitating its installation, or in the case of a mobile embodiment, it makes it more manageable. By means of guide elements which run along the approximate total length of the lateral cheeks, the platform may be moved into two end positions symmetrically distanced from the support, in which positions the platform extends beyond one or the other longitudinal side of the support. Therefore, a patient recumbent on the platform may be transferred from one side of the support and across it to the other side, as, for instance, from a bed onto a stretcher placed parallel to it, the transfer apparatus being positioned between them. Since in all positions of the platform a section thereof corresponding to the width of said support lies immediately above it, the platform is maintained on the support by means of guide elements in such a manner that it is cantilevered above the longitudinal sides of the support. Suitably, the lateral cheeks are mechanically reinforced by these guide elements to counteract a downward sagging of the cantilevered platform at least at its frontal side. As a consequence, the platform may remain in one of its end positions where its section projecting outward from the support does not rest upon any other surface, although it may be burdened by the weight of a patient lying upon it. This manner of operation requires less effort because the platform does not have to be moved so far back and above the area of the support that the patient lies directly above it, subsequently to having been loaded onto the platform. This feature may result in a gain of time which could be important when handling the victims of accidents. The possibility of driving the lower apron while the platform is idle permits a simultaneous motion of said lower apron and the conveyor apron, so that both aprons may be disinfected by means of a stationary disinfecting device, making this procedure simple and short because subsequent to the completed disinfecting procedure the conveyor apron cannot be contaminated by the lower apron. The separate mobility of the lower apron also facilitates operation in certain practical situations.

BRIEF DESCRIPTION OF THE DRAWINGS

The invention may be better understood from the following detailed description of preferred embodiments thereof taken with reference to the accompanying drawings wherein.

DETAILED DESCRIPTION OF THE PREFERRED EMBODIMENTS

Figure 1:
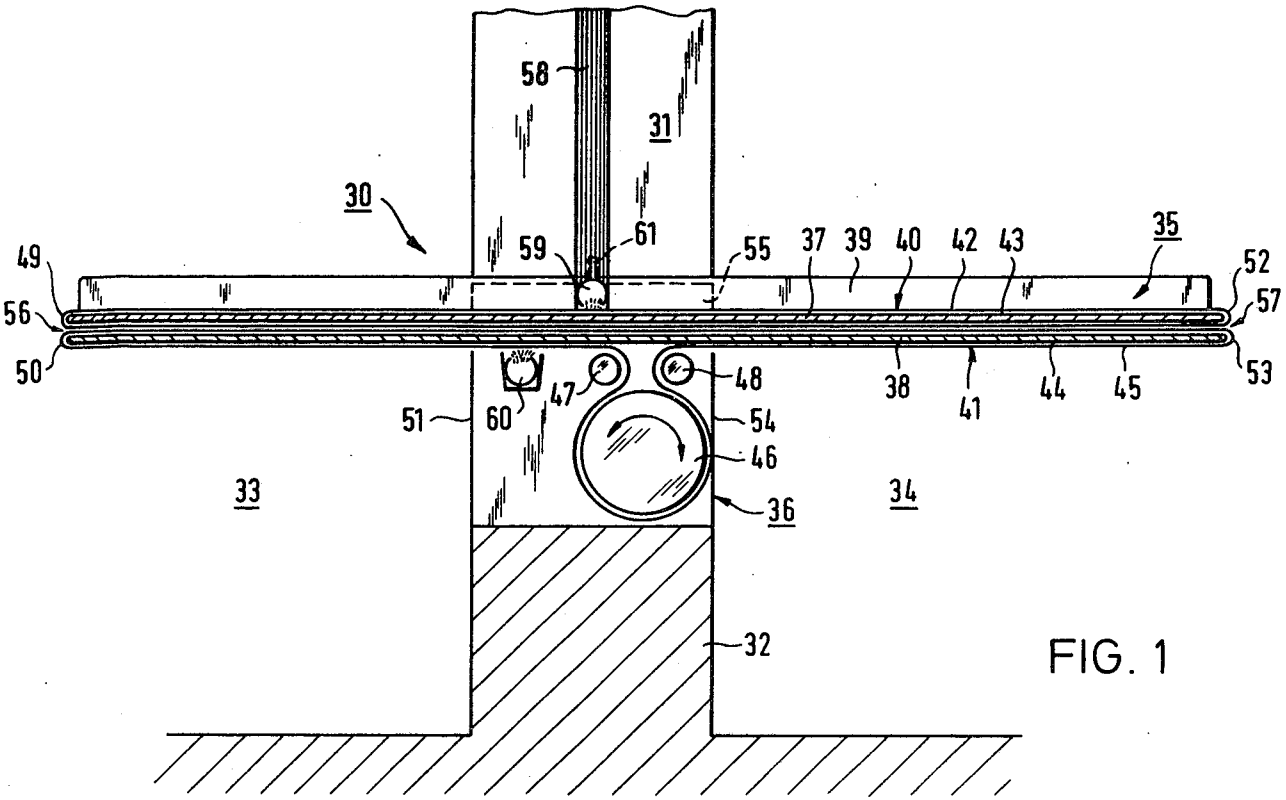
FIG. 1 shows a highly schematic cross section of an embodiment of a transfer apparatus according to the invention.

The highly schematic sketch of FIG. 1 shows a cross section of a transfer apparatus 30 which is held upon a ledge 32 within a wall opening 31 for the purpose of transferring recumbent patients from a non-sterile area 33 into a sterile area 34, as, for instance into an operation theater or a preparation room, as well as back into the non-sterile area. The transfer apparatus 30 is comprised of a horizontal platform 35 and a support 36 which extends below it and along its entire length, i.e. at right angles to the plane of the drawing, resting immediately upon the ledge 32.

The horizontal platform consists essentially of two horizontally arranged superposed rectangular separator plates 37, 38, which, at their frontal sides lying in front and behind the plane of the drawing respectively are connected to each other and to cheeks running along their entire width; one cheek 39 being visible in FIG. 1. The separator plates 37, 38 are superimposed upon each other at a distance equalling the thickness of a conveyor apron 40 plus a lower apron 41. The conveyor apron 40 is trained as an endless loop around the upper separator plate 37, and it is driven in a manner which is yet to be described, so that it moves either to the right or to the left in FIG. 1. The carrying run of the conveyor apron 40 with its upper side forms a surface upon which a patient rests. The lower run 43 of the conveyor apron 40, which runs between the separator plates 37, 38 touches with it underside the upper side of the carrying run of the lower apron 41. The lower run 45 of the lower apron 41 moves essentially below the underside of the lower separator plate 38.

A barrel drive 46 is provided within the support 36 to drive the lower apron 41; it is mounted at right angles to the running direction of the apron, extending across the width of the lower apron 41 measured at right angles to the plane of the drawing, around which barrel drive the lower run 45 of the lower apron 41 is trained. The barrel drive 46 is rotatable in both directions by means of a motor — not shown in this drawing. In order to obtain a large looping angle of the lower run 45 of the apron 41 around barrel drive 46, two freely rotatable deflection rollers 47, 48 are provided within the support 36, also extending across the entire width of the lower apron 41 at right angles to its running direction the lower run being looped and detoured towards the barrel drive 46 across their facing sides. The distance between the surfaces of the two deflection rollers 47, 48 is smaller than the diameter of the barrel drive 46. The vertical distance of the surfaces of the deflection rolles 47, 48 from the underside of the lower separator plate 38 corresponds to the thickness of the lower apron 41, In order to compensate for a possible stretching of the lower apron 41 during its use and in order to maintain the lower apron 41 in a state of constant even tension, it is possible, if so desired, to provide for one of the deflection rollers 47, 48 to be mounted horizontally movable in a manner not to be further described and to be put under spring tension at both of its ends to make it movable relative to the opposite deflection roller 47 or 48 respectively.

In the preferred embodiment the conveyor apron 40 is driven by the lower run 43 of the conveyor apron 40, being carried along by the carrying run of the lower apron 41. While there are several solutions possible for this operation, and we will address ourselves to them, the carrier effect can be obtained by frictional contact of the lower run 43 of the conveyor apron 40 with the carrying run of the lower apron 41. For that purpose, the conveyor apron 40 and the lower apron 41 may be manufactured, at least as far as their outer surfaces are concerned, in a conventional way, of materials with high friction coefficients. Materials suitable for such an apron may consist, for instance, of a fabric with low extensibility, as would be a glass fiber, or a polyacrylnitrile cloth which on its outer side is laminated to a polyurethane material and on its inner side is coated with polytetrafluoraethylene. The polyurethane has a a high friction coefficient, while the friction coefficient of polytetrafluoraethylene is low, and will keep the friction at the inner side of the separator plate 37 and the lower separator plate 38, respectively, at minimal levels. It has been shown to be of advantage to use such materials for the conveyor apron 40 and the lower apron 41 which materials provide great adhesion when coming in contact with the identical substance but which have a minimal friction coefficient when touching the usual synthetic and cotton fabrics as they are commonly used for bed clothes and bed sheets. We have such a material in polyvinylchloride. The apron could be made of strips of sailcloth as it is commonly used for tarpaulins on trucks and which is a fabric with low extensibility, coated with polyvinylchloride. If necessary, the inner surface of the apron material can again be coated with polytetrafluoraethylene. It has been found that, in order to obtain effective friction between the conveyor apron 40 and the lower apron 41, it may be sufficient to make either the conveyor apron 40, or the lower apron 41 on their outsides of a material with a low friction coefficient, for instance of polytetrafluoraethylene, and the respective other apron of a material with an outside of, for instance, polyurethane or a rubber which provide a high friction coefficient when coming into frictional contact with the aforementioned material. In this case, it is most suitable to have the outer side of the conveyor apron 40 made of the material with the low friction coefficient while the outer side of the lower apron 41 should be coated with the material with the high friction coefficient. This would ensure that the clothes of a patient being handled would not be pulled into the crevice between the separator plates 37, 38 while the conveyor apron 40 and the lower apron 41 are running into this crevice during the loading operation.

FIG. 1 shows the mean position of the horizontal platform 35 extending on both sides over the support 36 in the direction of the running sense of the aprons. The width of the support as measured in this running sense is less than half and in the preferred embodiment less than one fourth of the width of the platform 35. The platform 35 is horizontally movable parallel to the running sense of the aprons by means of a drive mechanism, not shown in FIG. 1, which is housed inside the support 36 and is yet to be described. From the mean position shown, motion in opposite directions into two final end positons symmetrical to support 36 is possible. In one of these positions the longitudinal edges 49, 50 of the separator plates 37, 38 are positioned approximately above the left longitudinal side of the support 36, so that the platform 35 extends to the right over the support 36. In a corresponding move, motion of the platform 35 toward the left into a final position can take place, thus positioning the right longitudinal edges 52, 53 approximately above the right longitudinal side of the support.

During its motion, the platform is guided between the frontal sides of the support 36, parallel to the running sense of the apron, which sides extend upwards and above its longitudinal sides 51, 54 and above the upper separator plate 37; one such frontal side 55, located behind lateral cheek 39 is indicated in dotted lines in the drawing of FIG. 1. Their width in the directional sense of the apron run corresponds to about the distance of the longitudinal sides 51, 54. When the platform is in one of its end positions, it remains guided along its frontal sides along the distance above the support 36, so that the platform 35 cannot tilt even if it should carry the weight of a patient at its outermost edges. Sagging of the free end of the platform 35 is largely avoided by providing a sufficiently rigid contruction. This can be achieved by chosing the proper thickness and material for the separator plates 37, 38, and by making the cheeks, with cheek 39 as mentioned, and the plates 37, 38 into a rigid, one-piece unit, for the cheeks extend above the separator plates 37, 38 by at least the sum total of the thicknesses of these separator plates 37, 38. As will be explained later on, the cheeks are further reinforced by guide elements which extend along the width of these cheek in the running sense of the motion of the apron, by tooth racks which drive the platform 35 and which provide an additional reinforcement against a horizontal sagging.

If desired, the platform 35 may be so rigidly contructed across its width in the running sense of the aprons that it does not sag noticeably under the weight of a patient. Any sagging is equally counteracted by the fact that the platform, in any of its positions, is braced by the dflecting rollers 47, 48. Divergent from the positon in which they are shown in the drawing it is possible to position the deflecting rollers 47, 48 and the barrel drive 46 somewhat lower in the support 36, so that the deflecting rollers 47, 48 actually no longer brace the barrel drive 46, thereby protecting the lower run 45 of the lower apron 41 which moves between the underside of the lower separator plate 38 and the deflecting rollers 47, 48.

Three main operational situations may be created by the simultaneous activation of the drive mechanism of the platform 35 and the drive mechanism of the lower apron 41, which in turn drives the conveyor apron 40, while the activation of merely a single one of these drive mechanisms is possible. In the operational situation "A" the platform 35 is moved into one of the areas 33, 34 while at the same time and in the identical running sense, the lower run of apron 41 is driven by means of the barrel drive 46 in such a manner that the lower run 45 of apron 41 and the carrying run of the conveyor apron 40 move with the running speed of the platform 35 in relation to the support 36, while they remain stationary in relation to the separator plates 37, 38, the lower run of the conveyor apron 40 and the carrying run 44 of the lower apron 41 moving in the opposite direction of the motion of the platform 35 with a running speed equal to the moving speed of the platform 35 relative to the support 36, and with twice the returning speed relative to the separator plates 37, 38. This operational situation is utilized whenever a patient recumbent on the platform 35 is to be transferred together with the platform itself. If desired, this operational situation "A" may be modified in such a manner that the lower apron 41 and the conveyor apron 40 are driven faster than the platform 35 so that during the motion of the platform a simultaneous, still faster, transfer of the patient in the direction of the frontal end of the platform 35 is achieved. This will be described later on.

In a further operation situation "B" only the drive of the platform 35 is activated or at least it is moved at a speed substantially greater than the running speed of the lower apron 41 and the conveyor apron 40. In this case the carrying run of the conveyor apron 40 and the lower run of the lower apron 41 remain essentially stationary in relation to the support 36, while they are gliding with the running speed of the platform 35 on the upper surface of the upper separator plate 37, and the bottom surface of the lower separator plate 38 respectively, and the speed of the lower run 43 of the conveyor apron 40 and the carrying run 44 of the lower apron 41 correspond to the simple speed of the motion of the platform 35, relative to the separator plates 37, 38, and twice the speed of the motion of the platform relative to the stationary support 36. The operational situation "B" is utilized whenever a patient recumbent on any surface is to be loaded onto the platform 35, or if he is to be unloaded from the platform 35 onto another surface. When loading a patient onto the platform, the respective front end of the platform 35 is brought beneath the patient, the carrying run 42 of the conveyor apron 40 is stationary relative to the support 36, and therefore also stationary relative to the patient himself, avoiding any friction between the upper separator plate 37 and the patient and the equally stationary lower run 45 of the lower apron 41 preventing friction between the lower separator plate 38 and the surface on which the patient lies. The same is valid for the process of unloading during which the platform 35 is pulled from beneath a patient recumbent upon it, depositing the patient on another surface. Inasmuch as the loading and unloading takes place without any frictional contact between the patient and the upper separator plate 37, and inasmuch as the total thickness of the separator plates 37, 38 in negligible (in the vicinity of 2 cm), this procedure protects the patient to the greatest extent.

A third operational situation "C" is created when merely the lower apron 41 and with it the conveyor apron 40 are activated while the platform 35 remains stationary. The conveyor apron 40 and the lower apron 41 in this case rotate around the separator plates 37, 38. This operational situation "C" is used to disinfect the conveyor apron 40 and the lower apron 41 which may have been contaminated during their stay in the nonsterile area 33 and/or by the contact with the patient, by taking the aprons past at least one stationary disinfector, preferrably an ultra-violet light.

In case that a single disinfector is provided this device can be directed against the left longitudinal side 56 as shown in FIG. 1, or the right longitudinal side 57, in order to simultaneously treat the conveyor apron 40 and the lower apron 41. After the disinfecting procedure it becomes necessary to remove the disinfector from the area of the platform 35, in order to free its path for the next operation. The embodiment shows an example of a preferrable construction. In this case, the opening 31 is closeable by means of a transparent wall element, which is movable in a vertical direction, and in this case consista of a glass pane 58. At its lower end there is a disinfecting device 59 for the disinfecting treatment of the conveyor apron 40, directed downward at the upper side of the carrying run of the conveyor apron 40 positioned vertically to its running direction and extending along the entire width of the apron in such a manner, that it is in operating position whenever the glass pane 58 is closed and moves upward together with the glass pane. For the disinfecting treatment of the lower apron 41 on the other hand, a disinfecting device 60 is positioned inside the support 36 facing upwards towards the underside of the lower run 45 of the lower apron 41. The disinfecting devices 59, 60 can be activated only when the upper disinfecting device is in its operating position for which a touch contact 61 may be provided alongside the glass pane 58, and in FIG. 1 located behind it. The disinfecting devices 59, 60 can thus be activated, dependent upon an appropriate signal and the use of the touch contact to be operative for a given space of time, the drive of the lower apron 41 and the conveyor apron 40 simultaneously being put into effect. The time allotted for the disinfecting process should permit at least one full revolution of the lower apron 41 and preferrably several such revolutions.

A modification of the transfer apparatus of the embodiment shown in FIG. 1 may be that in order for the conveyor apron 40 to be carried along by the lower apron 41, the lower run 43 of the conveyor apron 40 is connected to the carrying run 44 of the lower apron 41 in such a manner that the connecting line would run at right angles to the running sense of the apron and extend across the entire width of the apron. This connection is preferrably made by means of a seam or several seams in close proximity to each other so that it extends only minimally into the direction into which the aprons run. While in this case a multiple revolution of the conveyor apron 40 and the lower apron 41 around separator plates 37, 38 is impossible, the aprons may be driven while the platform 35 is stationary, and they may be disinfected by means of two disinfecting devices arranged along the longitudinal sides 56, 57 of the platform 35, directing their rays against the conveyor apron 40 and the lower apron 41.

Figure 2:
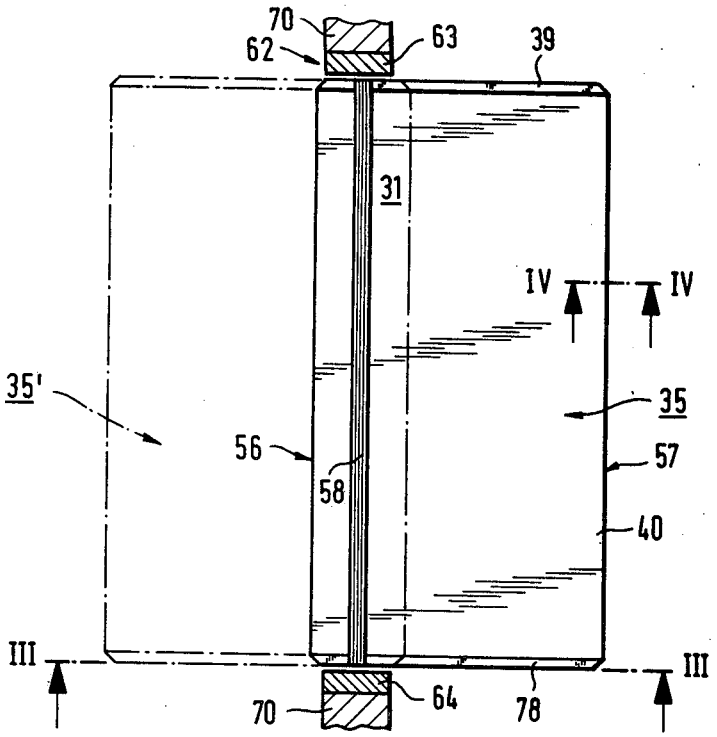
FIG. 2 shows the top view of a second embodiment of the transfer apparatus fragmentarily along the line II—II of FIG. 3.
Figure 3:
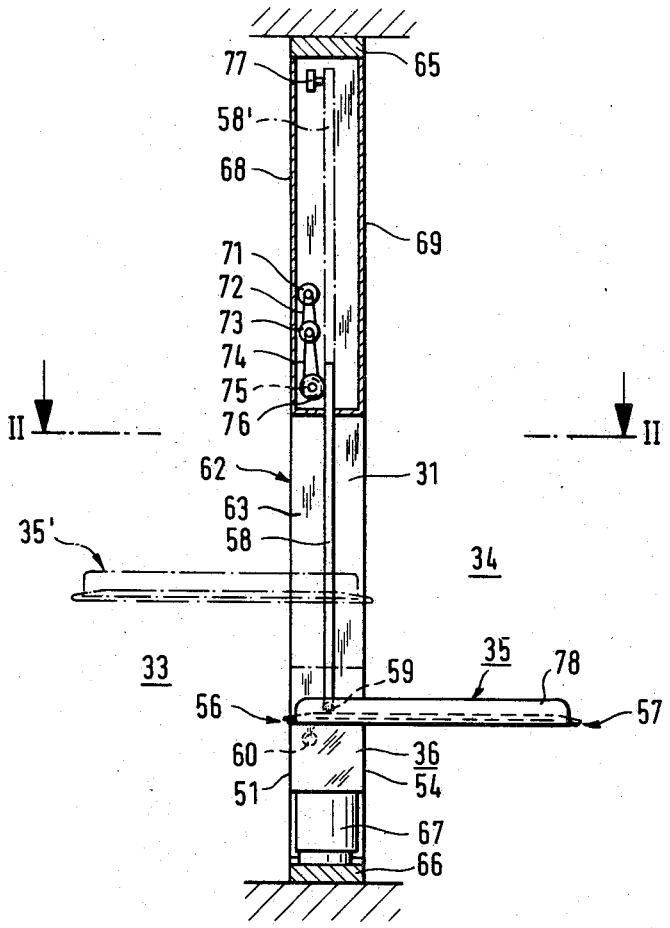
FIG. 3 shows the transfer apparatus of FIG. 2 in a fragmentary elevation taken along lines III—III of said FIG. 2.

The embodiment shown in FIG. 2 and FIG. 3 of a transfer apparatus is largely identical to the one as shown in FIG. 1. In this instance, the opening 31 within which the platform 35 is movable on its support 36, is shaped as the inside of a frame 62 consisting of vertical lateral beams 63, 64 and horizontal upper and lower beams 65, 66. The lateral beams 63, 64 shown in FIG. 2 in cross section are actually intended to be of hollow construction to house steering cables and the like. Support 36 (FIG. 2) extends across the width of the opening 31 as measured at right angles to the running sense of the apron, but it rests on the lower horizontal beam of the frame 62 on a telescopic base 67 or any other means which permits a height adjustment, making the platform vertically adjustable. Thus, the platform 35 may not only be moved horizontally between two end positions, but also vertically between two end positions, so that a position as indicated in broken lines at 35' in FIGS. 2 and 3 is possible, shown as having come from a position drawn in FIGS. 2 and 3 in solid lines. In this manner, the elevation of the platform 35 may be adjusted to various heights of surfaces from which or onto which a patient may have to be transferred. It is a particular advantage that such a surface may at first be positioned beneath the elevated platform 35 and that the platform 35 may be lowered subsequently. In this manner a motion of the platform in the operational situation "B" along the top of another supporting carrier is possible and it can thus be avoided that the platform bump against the side of any such carrier surface with one of its longitudinal sides 56, 57.

Again, as shown in FIG. 1, the opening is closeable by means of a vertically movable glass pane 58 with the disinfecting device 59 at its bottom. When pushed upwards, the glass pane 58 disappears into a housing which permanently closes the upper half of the opening, the outer sides 68, 69 of which as well as the longitudinal sides 51, 54 of the support 36 being flush with the outer sides of the frame 62 and the adjoining wall 70 (FIG. 2). The driving mechanism for the glass pane 58 is located within the space dilineated by the outer sides 68, 69. It consists of a spin resistant motor drive in the form of a gear motor 71, an overrunning clutch 73 (freewheel)driven by means of a chain 72 and at least one friction roller 76 which is driven by way of a chain 74 and chain wheel 75 and which rolls along the glass pane 58. As soon as the gear motor is turned on in one rotational direction, it drives the glass pane 58 upwards by means of the overrunning clutch 73 and the friction roller 76 until the glass pane reaches its uppermost position as indicated at 58' where it activates an end switch 77 which stops the motion.

It is also possible to manually move the glass pane 58 upwards, since the overrunning clutch 73 permits a counterclockwise rotation of the friction roller 76 in FIG. 3. It is advisable to provide at least one counterweight — in a manner not further described — or at least one relief spring to act upon the glass pane in an upward direction with a force which is approximately the sum total of the weight of the glass pane 58 plus the disinfecting device 59. In order to manually move the glass pane 58 upwards, only the remaining minimal force is required which is equal to the difference between the aforementioned total weight and the force provided by the counterweight or the releif spring respectively. This force plus any friction factors which may have to be considered should be approximately 2 kg and should definitely be less than 10 kg.

In order to move the glass pane 58 downwards, the rotational direction of the gear motor 71 is reversed. During this operation the weight of the glass pane 58 plus that of the disinfecting device 59, or rather the difference between their weights and the counterweight or the force exerted by the relief spring will try to turn the shaft of the overrunning clutch 73 by way of the friction roller 76 at a speed faster than that of the rotation provided by the gear motor 71, so that as a consequence the friction roller 76 and the glass pane 58 will not become disengaged from the gear motor. As soon as the glass pane reaches its final bottom position, however, and rests on the upper surface of the platform or any other suitable stop, the overrunning clutch 73 ensures that the glass pane 58 is no longer driven downward by the gear motor 71 which may still be running. In this manner a drive mechanism has been created which does not require much space and no great investments into its production and which also permits the glass pane 58 to be opened manually, and does not require safety measures to switch off the gear motor 71 when the glass pane 58 has reached its bottom position.

It would be particularly useful if the gear motor 71, when being used for the lowering of the glass pane 58, could be controlled by a time function element, for instance a time relay in such a manner that following a pre-set time subsequent to its start it is again turned off. This pre-set span of time is to be sufficiently long to permit the glass pane 58 to travel its maximum path at its given speed, which path lies between the top position as indicated at 58' and that bottom position in which the disinfecting device 59 is in its operational position above the conveyor apron 40 of the fully lowered platform 35. It can thus be guaranteed that the glass pane 58 will close securely at any elevation of the platform 35. The gear motor 71 will be turned off even if the glass pane 58 cannot reach its bottom position in which the disinfecting device 59 lies immediately above the conveyor apron 40 either because an object was left between the disinfecting device 59 and the conveyor apron 40 or because of any manipulation by the service personnel.

FIGS. 2 and 3 show that the platform 35 in addition to the lateral cheek 39 has a lateral cheek 78 at its opposite frontal side which is identical to the lateral cheek 39, rising above the level of the separator plates of the platform 35. The lateral cheek 78, however, is a mirror image of the lateral cheek 39, which will be clearly shown in FIGS. 10 and 12.

Figure 4:
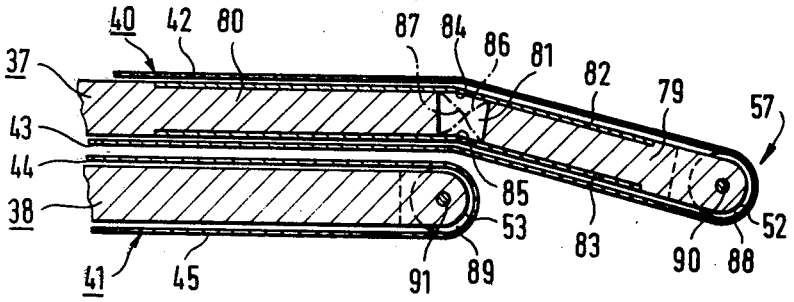
FIG. 4 shows a fragmentary cross section of the transfer apparatus of FIGS. 2 and 3 along lines IV—IV in FIG. 2.
Figure 5:
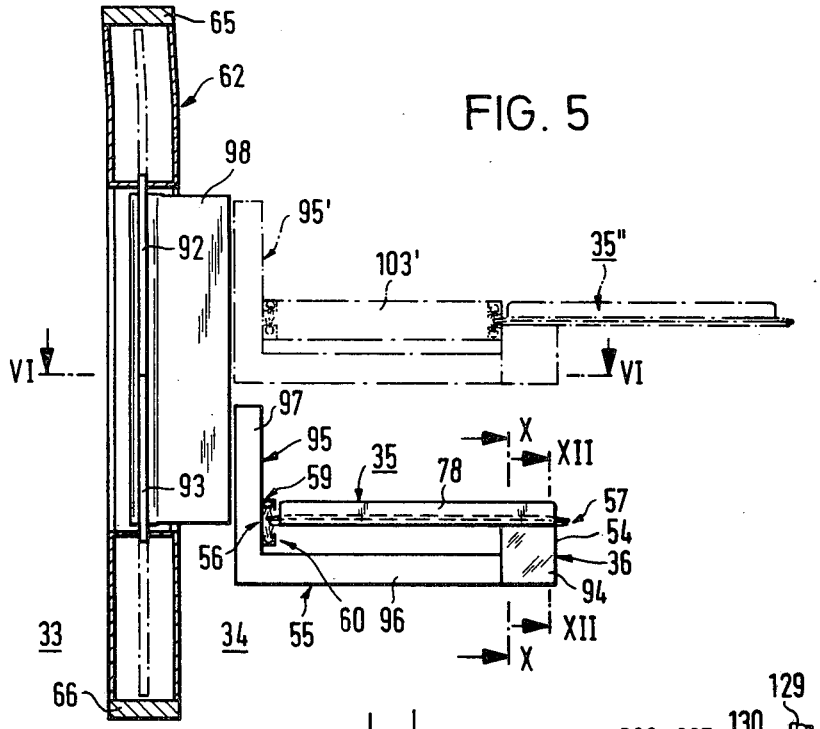
FIG. 5 shows a fragmentary side elevation of a third embodiment of the transfer apparatus.
Figure 8:
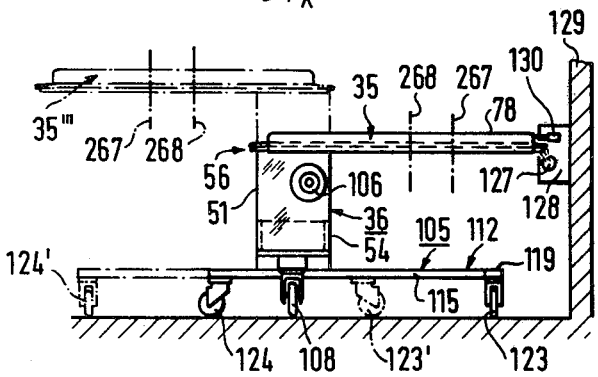
FIG. 8 shows a side elevation of the transfer apparatus of FIG. 7.
Figure 7:
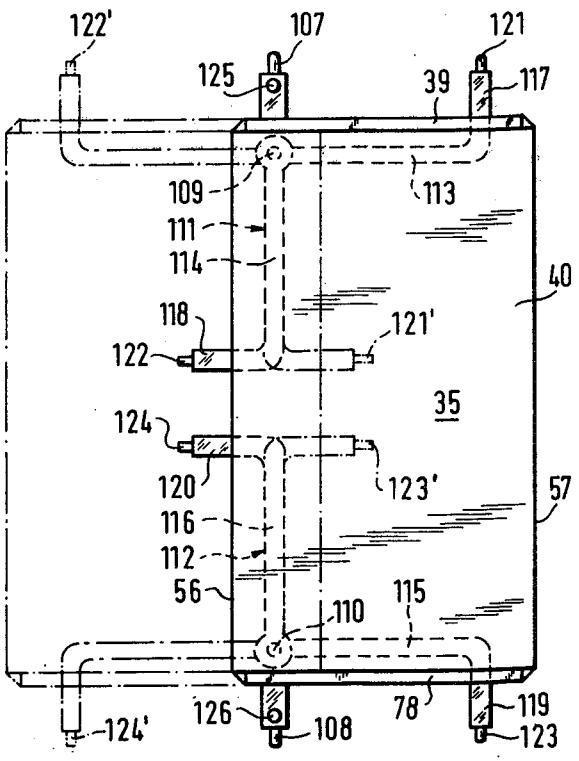
FIG. 7 shows a top view of a fourth embodiment of the transfer apparatus.
Figure 6:
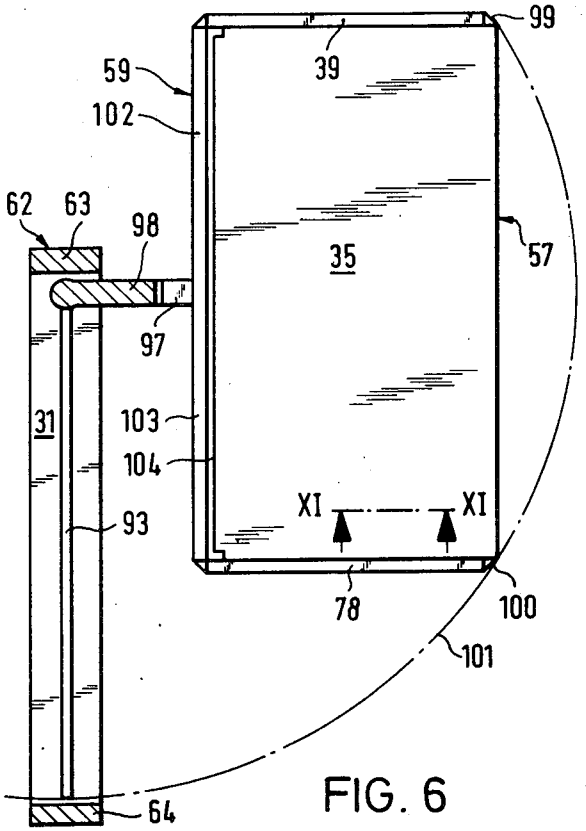
FIG. 6 shows a fragmentary top view of the transfer apparatus of FIG. 5 along line VI—VI.

While in the transfer apparatus as shown in FIG. 1 the longitudinal edges 49, 52 of the upper separator plate 37 are exactly vertically positoned above the longitudinal edges 50, 53 of the lower separator plate 38, which of great advantage especially in the operational situation "B", when the platform 35 is retrieved from underneath the unloaded patient to avoid the bedsheets being pulled into the crevice between the separator plates 37, 38; the platform 35 in the area of its longitudinal sides 56, 57 of the embodiment shown in FIGS. 2 and 3, and also in the embodiment shown in FIGS. 5 and 6, as well as in FIGS. 7 and 8, is of a different design, which is shown in detail in FIG. 4. This design has proved very practical. In it, the upper separator plate 37 with its longitudinal edge 52 extends outwardly over the longitudinal edge 53 of the lower separator plate 38 and from the point located above the longitudinal edge 53 of the lower plate 38 on, it is downwardly inclined. The opposite longitudinal side 56 of the platform 35 is shaped accordingly. The downwardly inclined sector 79 of the upper separator plate 37 adjoins its horizontal portion 80 at the point of a gap 81 and is connected to said horizontal portion 80 by means of two sheet metal elbows 82, 83, which are set flush into the upper- and undersides respectively of the horizontal portion 80 and the inclined portion 79, forming a band extending along the length of the upper separator plate 37 at right angles to the running sense of the apron. It is, however, possible to use a single, sufficiently rigid sheet metal elbow 82 or 83 and/or replace the sheet metal elbows 82, 38 with several sections distanced from each other which extend in ribbon shapes along the running direction of the aprons. Gap 81 is located above the longitudinal edge 53 of the lower separator plate, so that the bending points 84, 85 of the sheet metal elbows 82, 83 are in the area of the gap 81. This makes the longitudinal edge 52 of the upper separator plate 37 slightly resilient in both upward and downward directions. This effect can be increased, if desired, in that the sheet metal elbows 82 and/or 83 are given an undulating shape within the gap 81 as is indicated at 86 and 87.

In all these embodiments it is practical to provide the longitudinal edges of the separator plates 37, 38 with rollers to facilitate the run of the conveyor apron 40 and the lower apron 41 over these edges. Thus, in FIG. 4 the upper separator plate 37 along its longitudinal edge 52 has a multitude of spaced cylindrical rollers 88, the longitudinal edge 53 of the lower separator plate 38 being equipped in the same manner with rollers 89. These rollers 88, 89 are rotatable around axes 90, 91 respectively. It is, of course, possible to provide additional rollers within the separator plates 37, 38, for instance within the gap 81 inside of separator plate 37, or to replace separator plates 37, 38 entirely by a plane roller arrangement, as is known to prior art.

The transfer apparatus as shown in FIGS. 5 and 6 again serves the purpose of transferring a patient between a sterile area 34 and a relatively non-sterile area 33 through an opening 31. Again, this opening is closed by means of two glass panes 92, 93 which may be moved upwards or downwards respectively. In this case, the support 36 iscentrally held between its frontal sides 55 (FIG. 1) 94 by a swivel arm 95 close to one of the sides of the opening 31, extending beneath the platform 35 parallel to the running direction of the apron and being pivotable around a vertical axis. This swivel arm is L-shaped with a horizontal leg 96, the underside of which is flush with the underside of the support 36, and a leg 97 extending vertically upwards at the end of leg 96 which lies opposite the support 36. The vertical leg 97 on the side which faces the pivot axis is provided with guide elements, not shown, and is held in a vertical post 98 where it is vertically adjustable. The post 98 is located between the vertical lateral beam of the frame 62 and the glass panes 92, 93 and is pivotable by means of an actuating drive, not shown. The swivel arm 95 together with the support 36 and the platform 35 may be moved upwards by more than one half of the clearance of the opening 31 by means of another drive, not shown, fixed inside the vertical leg 97 or inside the post 98, and may be brought into an upper end position as indicated at 95'. For the purpose of loading and unloading of patients, the platform 35 may be brought into such a position, that its longitudinal side 57 extends over the support 36 and away from the pivot axis outward as indicated at 35''. In order to swivel the platform 35 through the opening 31, said platform is moved into its end position in the direction of the pivot axis as shown in full lines in FIGS. 5 and 6. To make this possible, the horizontal leg 96 of the swivel arm 95 is given a length which corresponds to at least, and in the preferred embodiment shown to exactly the difference of the width of the platform 35, as measured in the running sense of the apron and the support 36. The distance of the tip of the horizontal leg 96 which is attached to the support 36 from the pivot axis is longer by the average width of a human body than the difference cited, i.e. the distance from the rim of the vertical leg 97 from the pivot axis corresponds to the average width of a human body. As can bee seen from the top view of FIG. 6, this provides room for one servicing peron between the platform 35 and the glass panes 92, 93.

In its end position in the direction lying towards the pivot axis, the platform 35 is swivelled through the opening 31. During this operation, the corners 99, 100 of the platform 35 located away from the pivot axis, move along a circular path 101 which makes it evident that the clearance of the width of the opening 31 need only be insignificantly larger than the distance of the corners 99, 100 from the pivot axis.

Height adjustment of the glass pane 92 is most effectively achieved, as is described in FIGS. 2 and 3 for the glass pane 58, by means of a gear motor, an overrunning clutch and at least one friction roller. The height adjustment of the glass pane 93 may also be handled by way of the overrunning clutch in order to stop the motion of the glass pane being lowered whenever it is jammed by an object. It is further advisable to provide a slip clutch between the driving gear motor and the friction roller, which will prevent an upward displacement of the glass pane 93 in the case of an overload.

In the transfer apparatus according to FIGS. 5 and 6, at least one disinfecting device is effectively provided which is arranged at the swivel arm 95 at the elevation of the separator plates 37, 38 (FIG. 1). In the embodiment shown, there are, however, similiar to FIG. 1, two disinfecting devices, 59, 60 fixed vertically above each other at the outer side of the vertical leg 97 which faces away from the post 98. They are mounted at a distance to each other which corresponds to the difference between the width of the platform 35 and the support 36 and the longitudinal side 51 of the support 36 facing the pivot axis and they are in position to direct their rays against the conveyor apron 40 and the lower apron 41 respectively (FIG. 1) from above or below whenever the platform 35 is in the end position towards its pivot axis. The mutual distance of the disinfecting devices 59, 60 is at least as great as the total thickness of the separator plates 37, 38 plus the thickness of the conveyor apron 40 and the lower apron 41.

In one possible embodiment the disinfecting device 59, 60 is of rigid construction. As can be seen in FIG. 6, however, the upper disinfecting device 59 of the embodiment shown consists of two sections 102, 103. At their adjoining ends they are pivotably attached to the vertical leg 97, to be swivelled about a vertical axis and at their outer ends, lying close to the cheeks 39, 78 they are linked to a traverse rod 104, movable in a longitudinal direction and pivotable, which rod extends above the conveyor apron 40 (FIG. 1) between the ends of the cheeks 39, 78 lying towards the swivel axis. Whenever the platform 35 is moved away from the pivot axis, the outer ends which are linkes to the traverse rod 104 follow this motion so that the sections 102, 103 are brought into a position where they enclose an obtuse angle. The bottom disinfecting device 60 is provided in two parts and is pivotable; its sections are paired correspondingly with the upper disinfecting device 59 so that the sections of the bottom disinfecting device 60 are swivelled in the same manner as those of the upper disinfecting device 59. Their common swivelled position is shown in FIG. 5 at 103'.

The transfer apparatus as shown in FIGS. 7 and 8 is a mobile one on a chassis 105. In this embodiment the support 36 is vertically adjustable while the platform 35 may move into two end positions symmetrical to the support 36 as described previously in connection with aforementioned embodiments. Thus, it is possible to move the platform 35 from a position as drawn in full lines in FIG. 8 into the position as indicated at 35'''. For reasons of safety the vertical adjustment may not only be achieved by means of a motor — not shown — but also manually by means of a hand wheel drive 106, to facilitate the unloading of a patient onto another surface in case of a power failure. In case of such a power failure it is not absolutely necessary that the platform 35 and the aprons be activated because it is still possible to very carefully push the patient from the platform 35. Preferably, the energy for all mechanisms of the transfer apparatus is supplied by batteries, since they are portable and may be stored inside the support 36.

A battery charger may be added to recharge the batteries by connecting it to a power receptacle by means of a cable. The cable with a storage reel would also be stored inside the support 36. The aforementioned battery charger should have a capacity sufficiently large to supply the power needed to re-charge the batteries and to simultaneously provide the power needed when all drive mechanisms of the tranfer apparatus are in operation. In case of a depletion of the batteries it is thus possible to connect the transfer apparatus to receptacle and use it in the accustomed manner and to re-charge the batteries at the same time.

A useful feature of the mobile transfer apparatus consists in the possibility of making the operation of the drive mechanisms for the platform 35 and the conveyor apron 40 as well as the lower apron 41 disconnectable, should be battery capacity fall below a pre-set level, which could easily detected by monitoring their voltage. In this case, the essentially important vertical adjustment only would remain operative and would serve as an unmistakeable reminder to the servicing personnel that the batteries needed to be re-charged. In this embodiment additional manual operation by means of a handwheel 106 may be omitted.

It may be mentioned that an additional manual drive for the vertical adjustment could be provided in the embodiments as already described in FIGS. 2, 3, 5, 6. The energy supply for these embodiments preferrably comesfrom the public current supply. In the embodiment asshown in FIGS. 5 and 6 supply cables lead through the post 98 and the swivel arm to the support 36; Wiper contacts for the power transfer between the post 98 and the swivel arm 95 are not necessary since sufficient space is provided for a cable reserve inside of the post 98 to compensate for the vertical adjustment of the swivel arm 95. Returning to FIGS. 7 and 8, the chassis of the transfer apparatus comes under closer scrutiny. This chassis has two main casters 107, 108 with trailing effect, each of them being fastened close to one frontal side of the support 36 and underneath it in its center between its longitudinal sides 51, 54. The main casters 107, 108 are each journaled to the lower end of a rotatable shaft 109, 110 which extends downward from the underside of the support 36 and which shaft is maintained in a vertical position and pivotable about a vertical pivot axis. The chassis further consists of two horizontally arranged elbows 111, 112. These are formed essentially by two legs each 11, 114 and 115, 116 respectively, which are at right angles to each other and are connected with each other and with the shaft close to the vertex of this angle. A projection 117 to 120, short in comparison with the length of the legs, extends from each leg outwardly, as seen from the respective bisecting line of the angle. The projections 117 to 120 are equipped with secondary casters, 121 to 124, also with trailing effect, which are each journaled pivotably around a vertical axis. The secondary rollers 121 to 124 are somewhat smaller than the main casters 107, 108 because the weight of the support 36 must be born mainly by the main casters 107, 108.

When the platform 35 is in one of its end positions, for instance as shown in FIGS. 7 and 8 to the right of the support 36, one leg each of the elbow sections 111, 112, and in this example the legs 113, 115, extend into the same direction in which the platform 35 extends outwardly over the support 36. In order to obtain good stability it is evidently preferrable that the distance of the secondary casters 121 to 123 from the shaft 109, 110 respectively be about equal to the width of the platform 35. As soon as the platform 35 is moved to the opposite side of the support 36 and reaches the position as indicated at 35''', the elbow sections 111, 112 are moved simultaneously and in the identical sense of this motion while rotating the shafts 109, 110 to the opposite side of the support 36, until the secondary casters 121 to 124 have reached their positions as indicated at 121' to 124'. Even though the motion of the platform 35 transfers the center of gravity of the apparatus, this center always remains above the chassis 105 thus granting it a safe stability. The swivelling of the elbow sections 111, 112 is preferrably done by a motorized drive, and, most practically, the same motorized drive which activates the motion of the platform 35, and thus guarantees a synchronized operation.

In another embodiment the pivoting angle of the elbow sections 111, 112 is limited to 90 degrees in such a manner that in each end position one leg — in the position shown the legs 113, 115 — are parallel, and the respectively other leg — in the position shown in its legs 114, 116 — are at right angles to the running sense of the apron. In order that the elbow sections 111, 112 do not hamper each other during the swivelling process, a suitable length of the legs 113 to 116 is less than half of the length of the support 36. If the platform 35 should be especially wide, and if need be, a greater length for these legs may be permissible, provided that they are so shaped that they do not interfere with each other. So, for instance, the leg 114 in FIG. 7, coming from shaft 109, may run closer to the left side of the support 36, while leg 116, coming from shaft 110, may extend closer to the right side of the support 36, so that casters mounted at the free ends of these legs are pivotable without mutual interference even if these legs extend beyond the center of support 36 and towards the other frontal side. In contrast to the embodiment shown, a variation is possible whereby the legs 113 to 116 are not arranged in pairs at right angles to each other but at other, particularly at obtuse angles. Thus, to name an example, the leg 113 and the projection 117 might be replaced by a leg which would run from the shaft 109 in a straight line to the secondary caster 121 and, correspondingly, a leg could run from the shaft 109 to the secondary caster 122, which leg then would form an obtuse angle with the aforementioned leg.

During a possible motorized swivelling of the elbow sections 111, 112 beneath the support 36 the friction of the secondary casters 121 with the floor exerts a minor force parallel to the running sense of the apron. Inasmuch, however, as the main casters 107, 108 provide a resistance against a lateral motion of the support 36 by rolling, this will generally prevent any uncontrolled motion. It is also possible for the servicing person who controls the motion of the platform 35 and the swivelling of the elbow sections 111, 112 to easily hold the apparatus in its place. Finally, a lateral motion can be completely eliminated by blocking the main casters 107, 108 by means of a braking device provided for them; the top view of FIG. 7 shows push buttons to be foot-operated which are part of a corresponding locking brake device.

Variations in the design of the chassis 105 from the embodiments shown are possible. For instance, the chassis may consist of a rectangular frame, or a rectangular plate of about the dimensions of the platform 35 as seen in top view, the corners of the chassis having four casters with trailing effect. Should then, during the motion of the platform the support be held stationary, the chassis would move on the floor in such a manner that it is always underneath the platform. Should, on the other hand, the chassis be held stationary on the floor by blocking at least two casters, and the platform then be moved, a lateral motion of the platform against the support results in a lateral motion of the support on the chassis, while at the same time the platform remains stationary relative to the chassis and the floor.

Another practical variation of the chassis consists in a feature which provides braking devices for its casters which are manually and simultaneously operated. Corresponding levers may be arranged on both frontal sides of the support 36, permitting a blocking of the main casters 107, 108 or other casters of the chassis, even in case that they should be positioned in such an area within the angle of their swivel position which is inaccessible from above. The activating levers provided at both frontal sides would make it unnecessary that the servicing person would have to go from one frontal side to the other and possibly back in order to brake the casters.

In FIG. 8 a disinfecting device as part of the transfer apparatus is contained in a housing 128 attached to a wall 129. The housing 128 has a horizontal slit to receive the longitudinal edges — for instance the longitudinal edges 52, 53 (FIG. 4) of the separator plates 37, 38 — only in the event that the support 36 together with the platform 35 is in the bottom endposition of the vertical adjustment. As soon as the longitudinal edges are introduced, the outermost ends of the lateral cheeks 39, 78 activate a switch 130 which, whenever a corresponding signal is given, turns on the disinfecting device 127 for a pre-set length of time.

Figure 9:
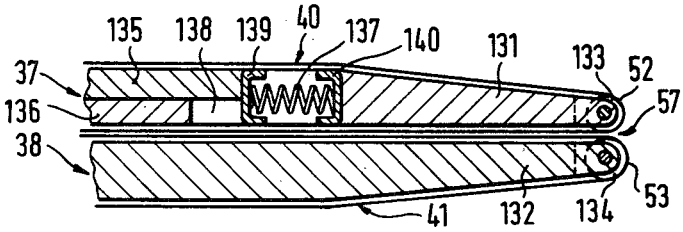
FIG. 9 shows a possible modification of all embodiments in a vertical cross section similar to FIG. 4.

FIG. 9 shows a possible variation of the platform in the area of both of its longitudinal sides as shown in a partial section through the separator plates 37, 38 within the area of the longitudinal side 57. In this case, the longitudinal edges 52, 53 of the separator plates 37, 38 are positioned vertically above each other and separator plates 37, 38 are tapered in sections 131, 132 adjacent to the longitudinal edges 52, 53 and towards these edges, so that the common cross section of the separator plates 37, 38 is cuneiform. In this manner, a transfer of the patient during the loading and unloading is particularly gentle. Along the longitudinal edges 52, 53 the conveyor apron 40 and the lower apron 41 are again deflected by means of rollers 133, 134 similar to the manner described in connection with FIG. 4.

FIG. 9 shows another possible variation which may be applied to all embodiments of the transfer apparatus. In this variation, the upper separator plate 37 consists of two plates 135, 136 which are movable against each other and parallel to the plane of the surface of the plate, only one of these parts being connected with the lower separator plate 38 and the lateral cheeks 39, 78 (FIG. 7) and several worm springs 137 being spaced across the width of the separator plate 37 between them. In this manner the conveyor apron 40 is kept in a constant uniform state of tension, should there occur a possible stretching. The worm springs 137 are each arranged within a recess 138 of the upper separator plate 37 and are supported on shaped pieces 139, 140, shaped piece 139 being connected to the upper part 135 of the separator plate 37, the shaped piece 140 being attached to section 131 which is connected to the lower part 136.

Figure 10:
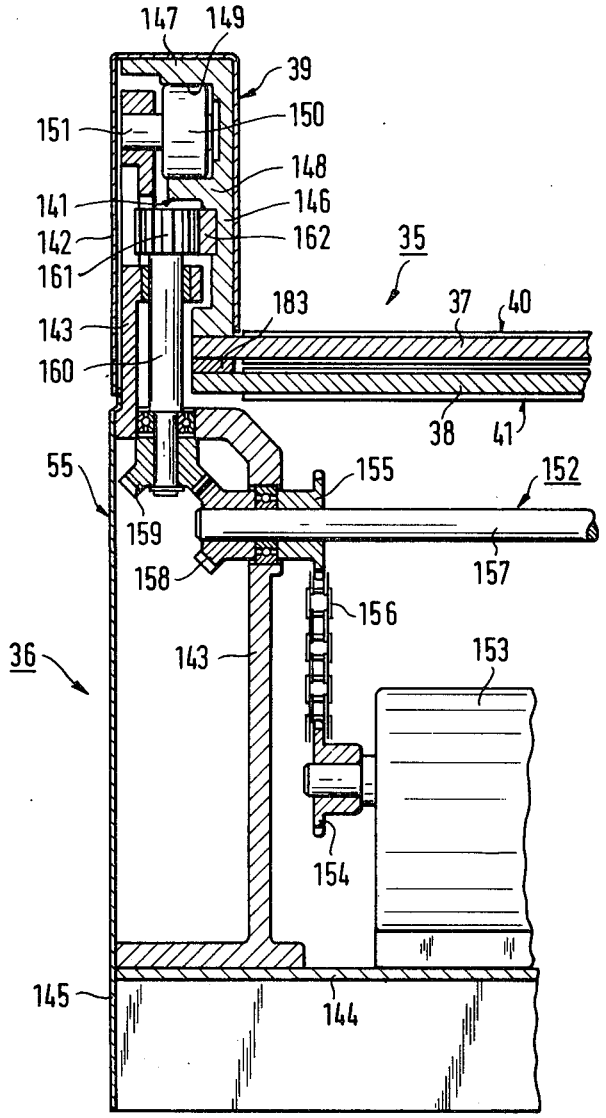
FIG. 10 shows a longitudinal section of the drive mechanism for the platform of the transfer apparatus of FIGS. 5 and 6 along lines X—X in FIG. 5 and FIG. 11.

FIG. 10 shows a cross section through the platform 35 and the support in the area of one frontal edge. It can be seen that the lateral cheek 39 rises above the separator plates 37, 38 to a height which is a multiple of the total thickness and essentially consists of a profile section 141 covered by a U-shaped coating sheet 142 which is open at the bottom, while the frontal sides of the support 36 consist of a casting 143 which is supported by a base plate 144 and has a sheet metal coating 145 over its outside.

The profile section 141 has an approximately L-shaped cross section with a vertical leg 146 and an upper horizontal leg 147 which extends outwardly from the leg 146. This design adds to the rigidity of the platform 35. At about the half-way point of its height the profile section 141 has a ledge 148 which juts out to form a channel bwtween its upper side and the underside of the upper leg 147. The channel 149 extends nearly across the entire width of the lateral cheek 39 as measured in the running sense of the apron and serves as a guide element to guide the platform 35 during its horizontal motion. Two rollers, provided close to both ends of the wall 55 and approximately above the lateral walls 51, 54 (FIG. 5) rotate within the channel 149. Such a roller 150 is visible in FIG. 10. It is rotatably and axially immovably journaled on a horizontal shaft which is connected to the upper rim of the casting 143.

The driving mechanism 152 which is used to move the platform 35 consists of an electrical motor 153 fastened to the base plate 144 and a shaft 157 driven by said motor by means of chain wheels 154, 155 and a chain 156. This shaft extends from the frontal area shown of the support 36 and through it as far as to the opposite frontal area which is the first frontal section's symmetrical mirror image, to be operated by the aforementioned drive mechanism and the mechanisms which will be described in the following.

Figure 11:
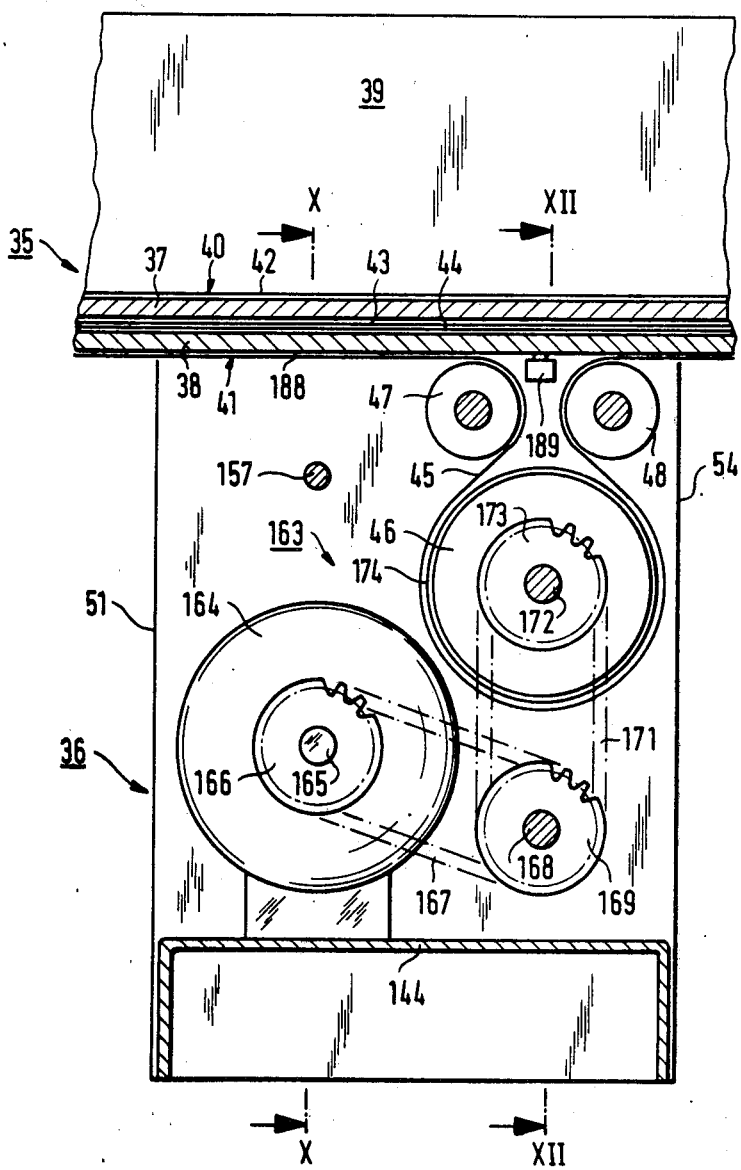
FIG. 11 shows a fragmentary cross section of the drive mechanism for the aprons of the transfer apparatus of FIGS. 5 and 6 along lines XI—XI in FIG. 6 and FIG. 12.
Figure 12:
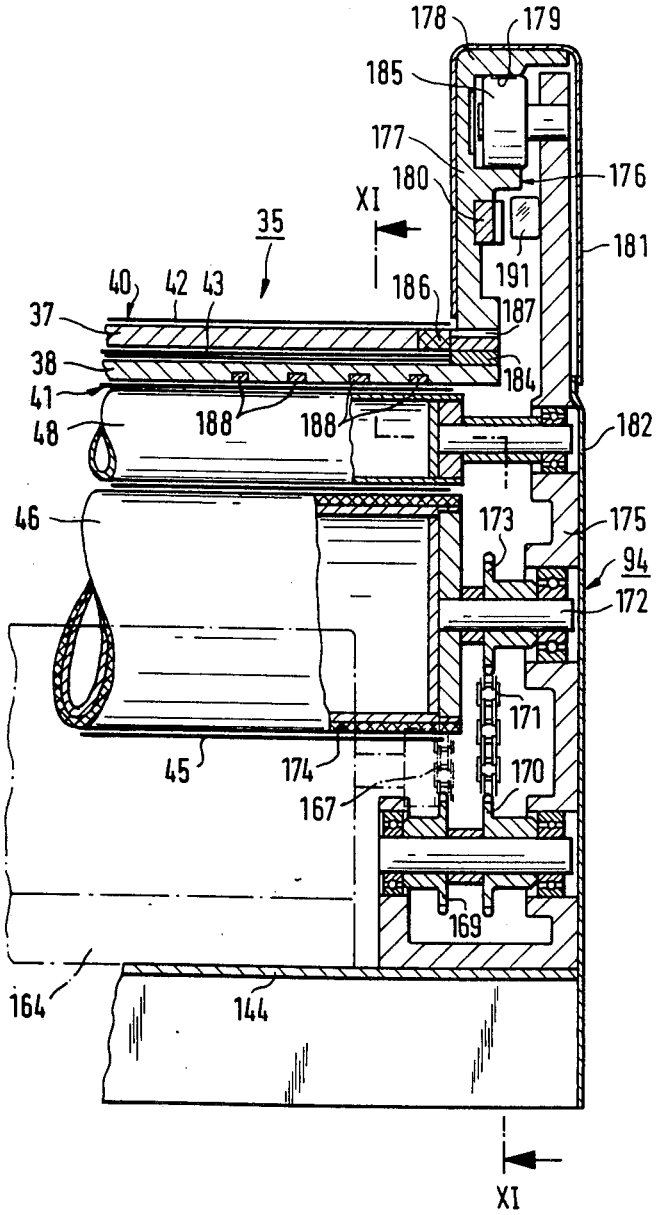
FIG. 12 shows a fragmentary cross section of the drive mechanism of the aprons of the transfer apparatus of FIGS. 5 and 6 along lines XII—XII in FIG. 5.

The shaft 157 by means of bevel wheels 158, 159 drives a shaft 160 which is journaled inside the casting 143 in a vertical position. Shaft 160 at its upper end has a pinion 161 meshing with a toothed rack 162. This toothed rack 162 is at least as long as the path of the motion of the platform 35 and should extend across the entire width of the lateral cheek 39, as measured in the running sense of the apron. In this manner the toothed rack 162 as well as the ledge 148 serve to increase the flexural strength. The drive mechanism 163 which drives the barrel drive 46 and thus the lower apron 41 is shown in FIGS. 11 and 12. It consists of a motor 164, fastened to a base plate 144, which, by way of a chain wheel 166 attached to its shaft 165, by a chain 167, by chainwheels 169, 170 attached to a shaft 168, and a chain 171 drives the chain wheel 173 which in turn is attached to the shaft 172 of the barrel drive 46.

In order that the barrel drive 46 may drive the lower run 45 of the lower apron 41 without slippage, saidbarrel drive 46 has a laminated coating 174 with a high friction coefficient, for instance of a polyurethane. Shaft 168, shaft 172 and rollers 47, 48 are journaled within a casting 175 of the frontal side 94 which is — as has been mentioned — a symmetrical mirror image of the frontal side 55 (FIG. 10). The drive mechanism 163 opposite the drive mechanism 152 has an additional motor 164 to move the platform 35 which makes an operation of the lower apron 41 and thus of the conveyor apron 40 possible even when the platform 35 is not in operation.

Divergent from the embodiment of the drive mechanisms 152, 163 as shown in FIGS. 10 to 12a single common motor could be provided. In this case the drive mechanism for the lower apron 41 and — in the embodiments heretofore described — for the upper apron 40 could be rigidly connected with said motor, the platform 35 being connected thereto by means of a disengaging clutch. This would result in the further possibility of driving the lower apron 41 when the clutch is disengaged and the platform 35 isthereby made stationary. In an embodiment which is yet to be described and which provides a separate drive mechanism for the conveyor apron 40, the conveyor apron 40 in a corresponding manner could be in gear with the motor drive while the platform 35 is driven by way of a disengaging clutch.

In order to monitor the comparative speed of the conveyor apron 40 and the upper separator plate 37 and thus the platform 35, a monitoring device in form of a reflex-light barrier 186 is set into the upper separator plate 37. This barrier faces either the carrying run 42 or the lower run 43. The inside of the conveyor apron 40 is imprinted with markings in the shape if stripes at regular intervals which run across the reflex-light barrier thereby creating an impulse for an output signal; the frequency of the impulse signal being in direct proportion to the comparative speed. This signal may be utilized for the surveillance and/or the regulation of the comparative speed. the connecting wires of the reflex-light barrier 186 which are not shown, go through a channel 187 towards the edge of the plates lying within the lateral cheek 78 and are connected to busbars 188 set into the underside of the lower separator plate 38, after passing a suitable channel, which is not shown. Wiper contacts 189 (FIG. 11) arranged between the rollers 47, 48 take care of the power transfer to the support 36 and an indicating steering mechanism which is not shown.

Figure 13:
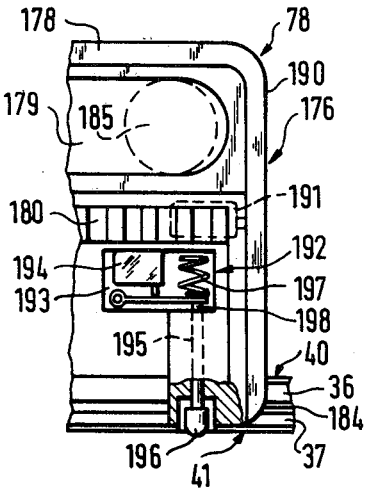
FIG. 13 shows an outside view of the end of a lateral cheek in the embodiment of FIGS. 5 and 6.

FIG. 13 shows, as an example, the right edge of the lateral cheek 78 of FIG. 5 after the sheet metal coating 181 has been removed (FIG. 12); the rest of the edge of the lateral cheeks is correspondingly shaped. The upper leg 178 of the profile section 176 continues here in a vertical leg 190 which may serve as a mechanical stop for the roller 185. This mechanical stop is provided for safety purposes only, for normally the path of the motion of the platform 35 is limited in that in the end position of the platform 35 the leg 190 activates an end switch 191 which is attached to the inside of the casting 175 opposite the toothed rack 180.

In an embodiment of the apparatus which is vertically adjustable it is advisable to provide devices near the longitudinal sides 56, 57 of the platform 35 which give a signal during the operation which lowers the platform onto another surface whenever the platform 35 settles upon said surface in order to stop the descent. Such a device may operate electrooptically. It would still be preferrable, however, if push-switches could be provided close to the longitudinal edges 49, 50, 52, 53 — in case of the embodiment according to FIGS. 5 and 6 only at the longitudinal edge 57 of the platform 35 — and preferrably at the ends of the lateral cheeks 39,78 which give a signal as soon as the underside of the platform registers pressure. This will prevent the descent from being terminated too soon whenever contact is made with a comparatively soft bed. Such a push-switch 192 is shown in FIG. 13. It consists of a switch 194 mounted on a plate 193, and a tappet 195, which is guided vertically and movably inside the profile section 176 and has a sensor button 196 at its lower end which extends downward beneath the underside of the lower apron 41. Whenever the platform 35 makes contact with another surface and pressure is exerted upon the sensor button 196 in an upward direction, the sensor button compresses a helical spring 197 and the upward motion of the tappet 195 — given a pre-determined amount of pressure — will suffice to activate a switch 194 by way of a lever 198.

Figure 14:
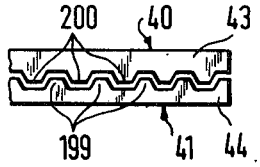
FIG. 14 shows the side elevation of a possible modification of the aprons in all embodiments.

The conveyor apron 40 may not only be carried along by the lower apron 41 by frictional contact but also be a method whereby the aprons are in locking contact with each other. For instance, the conveyor apron 40 and the lower apron 41 could be provided on their outsides with rough areas or with ridges extending at right angles to the running sense of the aprons. A particularly good solution requiring but simple manufacture is advanced which provides the conveyor apron 40 and the lower apron 41 along their respective edges with toothed belts with their teeth directed outwardly. This has been indicated in FIG. 14. The upward directed teeth 199 of the carrying run 44 of the lower apron 41 here mesh with the downward directed teeth 200 of the lower run 43 of the conveyor apron 40. It is understood that in this case the driving of the lower apron 41 may be accomplished by means commonly used for the operation of toothed belts instead of by means of the barrel drive 46 (FIG. 12).

Figure 15:
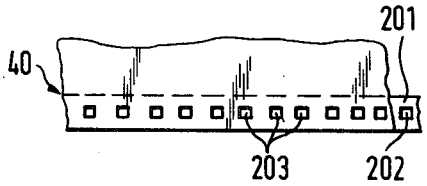
FIG. 15 shows a fragmentary top view of the rim of an embodiment of the aprons which may be used with all embodiments of the transfer apparatus.
Figure 16:
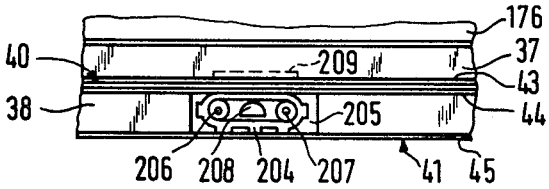
FIG. 16 shows a side elevation of a possible modification usable with several embodiments of the transfer apparatus together with the aprons in FIG. 15.

FIGS. 15 and 16 show an additional useful solution in which the conveyor apron and the lower apron 41 are coupled in locking contact. In this embodiment the conveyor apron 40 and the apron 41 — as shown in FIG. 15 for the conveyor apron 40 — each are perforated along both of their edges in the manner of a perforation used in film transport, and reinforced by an insert 201, consisting, for instance of a steel ribbon; the perforation 202 of the insert 201 corresponds to the perforation 203 of the respective aprons. The lower run of the conveyor apron 40 and the carrying run 44 of the lower apron 41 are then coupled on both sides by means of toothed elements contained and rotating within the lower separator plate 38, their teeth being in simultaneous engagement through the perforations with the lower run 41 and the carrying run 44. FIG. 16 shows such an element as a toothed belt 204, arranged in a recess 205 of the lower separator plate 38. It is trained around deflector rollers 206, 207 and is pressed against the inner side of the lower run 44 of the lower apron 41 by means of a projection 208 in such a manner that its teeth extend at least into the perforation 203 of the conveyor apron 40. A recess 209 within the upper separator plate 37 prevents wear of the top of the teeth. In this proposed embodiment as in the one suggested in FIG. 14, the barrel drive may be omitted and be replaced by a spiked roller driving one of the two wheels to move the lower apron 41.

Figure 17:
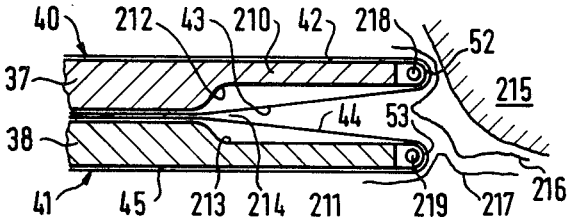
FIGS. 17 and 18 show longitudinal sections as in FIGS. 4 and 9 of modified designs of the longitudinal edges of the platform of the transfer apparatus useable in all embodiments.

In the foregoing it has been mentioned on several occasions that suitable measures may be taken in order to avoid bed clothes and bed sheets from being pulled into the crevice between the separator plates 37, 38 during the unloading of a patient onto another surface in the operational situation "B" in which the platform 35, its conveyor apron 40 held stationary, is pulled from beneath a prone patient. An additional suitable measure is shown in FIG. 17. Here, the separator plates 37, 38 in sections 210, 211 which are adjacent to their longitudinal edges 52, 53 are of a thickness which is less than the thickness of the rest of the plates, in such a manner that they form grooves 212, 213 which face each other. In this manner, the point 214 where the lower run 43 of the conveyor apron 40 and the carrying run 44 of the lower apron 41 make contact when running into the crevice between the separator plates 37, 38 is in a location away from the longitudinal edges 52, 53 and lies further to the inside. When the separator plates 37, 38 in FIG. 17 are retrieved from beneath the body of the patient as indicated at 215, the losely hanging clothes 216 of the patient or a sheet 217 which may be crumpled upon a bed cannot touch the point 214 where they could be caught and pulled into the crevice between the separator plates 37, 38.

Figure 18:
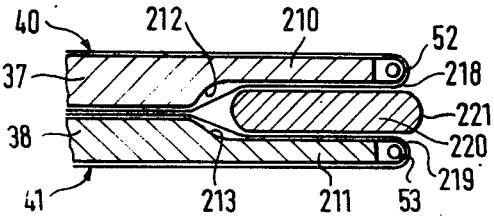

The conveyor apron 40 and the lower apron 41 at their longitudinal edges 52, 53 are again detoured around deflector rollers 218, 219 as has been described before in connection with FIG. 4. The same is valid for the embodiment as shown in FIG. 18 which is a variation of the embodiment of FIG. 17, whereby a moulding 220 is positioned between the opposite and facing grooves 212, 213 of the separator plates 37, 38 extending alongside the longitudinal edges 52, 53 of the plates and at its ends connected to the edges of the plates and the lateral cheeks 39, 78; the outer longitudinal surface 221 of said moulding being rounded, and, preferrably, as shown in FIG. 18, slightly protruding outward beyond the longitudinal edges 53, 54 of the separator plates 37, 38. The longitudinal edge 221 of the moulding 220 thus acts as a deflector which also prevents a pulling of sheets and similar objects into the crevice between the separator plates 37, 38.

In the embodiments heretofore described the conveyor apron 40 has always been driven by the lower apron 41. It is, however, possible to provide a separate drive mechanism for the conveyor apron 40. Several other desirable operations thus become possible. So, for instance, during the operational situation "B", the upper conveyor apron may be held stationary in relation to the platform 35 in order to avoid all friction between the upper separator plate 37 and the patient, while the lower apron 41 is driven at a low speed in such a manner that its lower run 45 moves away from the body of the patient 215 (FIG. 17); in this manner, the sheet 217 is smoothed out and cannot be pulled into the crevice between the separator plates 37, 38. It has also been shown that a separate drive of the conveyor apron 40 and the lower apron 41 avoids with certainty any formation of folds and creases created by an oblique motion of the aprons under the most unfavourable conditions caused by a possible uneven weight distribution on the platform 35. The latter advantage may be gained even when the conveyor apron 40 and the lower apron 41 are operated by means of separate drive mechanisms, these mechanisms sharing a common motor so that merely a simultaneous operation of the conveyor apron 40 and the lower apron 41 is possible.

Figure 19:
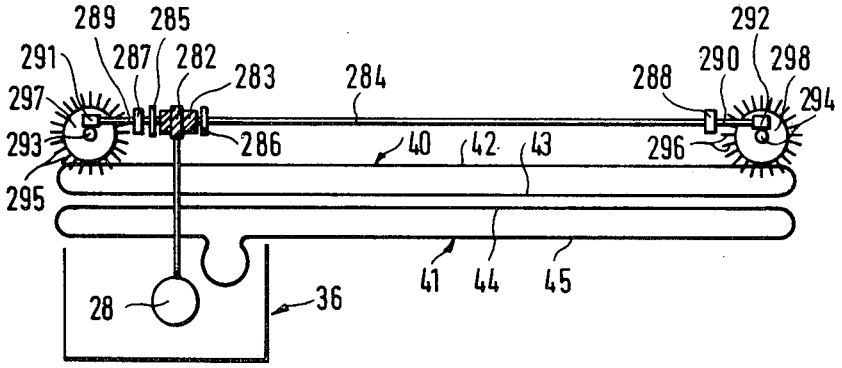
FIG. 19 shows a highly schematic cross section of a transfer apparatus in a fifth embodiment.
Figure 20:
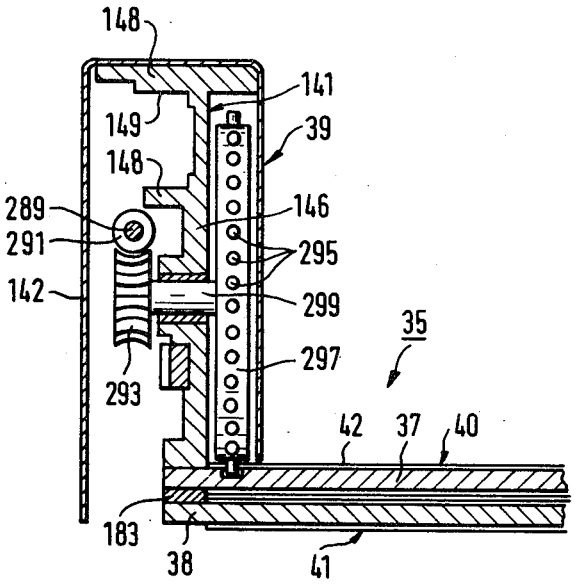
FIG. 20 shoes a partial cross section of the platform of the transfer apparatus of FIG. 19.

FIGS. 19 and 20 indicate a separate drive mechanism for the conveyor apron 40 only and are a fragmentary drawing to show how it effects one edge of the conveyor apron 40. In fact, both edges of the conveyor apron 40 are driven in the identical manner by means of a single motor 281, housed inside the support 36. The motor 281 drives — as is schematically sketched in FIG. 19 — a worm wheel 283 by means of a worm 282; this worm 282 and worm wheel 283 may as well be a pair of bevel wheels instead. The worm wheel 283 has a contour shaft 284, non-rotatably but axially movably connected thereto. Axial motion of the worm wheel 283 relative to the frontal side of the support 36 is prevented by means of projections 285, 286 which jut out from the inside of the casting 143 on the side which faces the profile section 141 (FIG. 10) and in which the contour shaft 284 is journaled rotatably and longitudinally movable. The contour shaft 284 extends across nearly the entire length of the lateral cheek 39 and is not supported by said lateral cheek 39 at a distance which corresponds to the length of the path of the motion of the platform 35; it is merely supported by the projections 285, 286. A journalling or a support of the contour shaft 284 at or in the lateral cheek 39 is effected exclusively outside the range of the motion of the contour shaft 284 along which range it is movable, along with the lateral cheek 39, and relative to the worm wheel 283. At least one end of the contour shaft 284 operates a drive mechanism by way of a suitable gear in mesh with one edge of the conveyor apron 40 and is journaled in the lateral cheek 39. In the embodiment shown, the contour shaft, by way of a monodirectional gear 287, 288 a shaft segment 289, 290, a worm 291, 292, and a worm wheel 293, 294 is coupled with a wheel 297, 298 having spikes 295, the shaft of which wheel is journaled within the leg 146 where the carrying run 42 of the conveyor apron 40 is located. The spikes 295, 296 of the wheels 297, 298 reach into the perforations 203 FIG. 15) along the edge of the conveyor apron 40. Depending on the needed running direction of the conveyor apron 40, either gear 287 is used to drive the wheel 297 only, or gear 288 is used to drive the wheel 298 in order to keep the conveyor apron 40 taut within the area of the advancing longitudinal edge 49 or 52 respectively (FIG. 1) of the upper separator plate 37.

In the embodiment shown, the drive mechanism for the conveyor apron 40 has a motor 181 in addition to the drive mechanism 152 (FIG. 10) for the platform 35 and the drive mechanism 163 (FIG. 11) for the lower apron 41. It is, however, quite possible to provide a common drive mechanism for the platform 35 and the upper apron 40, the upper a pron 40 then being in rigid gear with the common motor, the platform 35 and the motor, however, being connected by a disengageable clutch so that the platform 35 may be idle during the disinfecting procedure. Further variations of the device are shown in FIGS. 19 and 20 with respect to the kind and number of the drive elements used in driving the edges of the conveyor apron 40. Thus, for instance, is it possible to use drive rollers which have a considerably smaller diameter in place of the wheels 297, 298, with spikes 295, 296; provided that they are coated with a material having a high friction coefficient and which press the driven edge against opposing rollers journaled within the upper separator plate 37. A multitude of such drive elements distributed across the width of the lateral cheeks 39, 78 (FIG. 12) may be provided as long as these elements are only driven by the ends of the contour shaft 284, or, for instance by another shaft running parallel to it.

It maybe mentioned that the separator plates 37, 38 in all of the embodiments of the transfer apparatus may be manufactured out of a paper-base laminate permeated with melamine resin. This gives a raw material of great flexural strength, it is easy to handle and, if used for plates, it provides smooth surfaces with a low friction coefficient and has the additional advantage that it will not bar X-rays so that the transfer apparatus may also serve as an X-ray table. A transfer apparatus of this invention may be set into guide elements on the floor, installed at right angles to the running sense of the aprons and in this manner becomes an X-ray table with the possibilities of a threedimensional adjustment.

Figure 21:
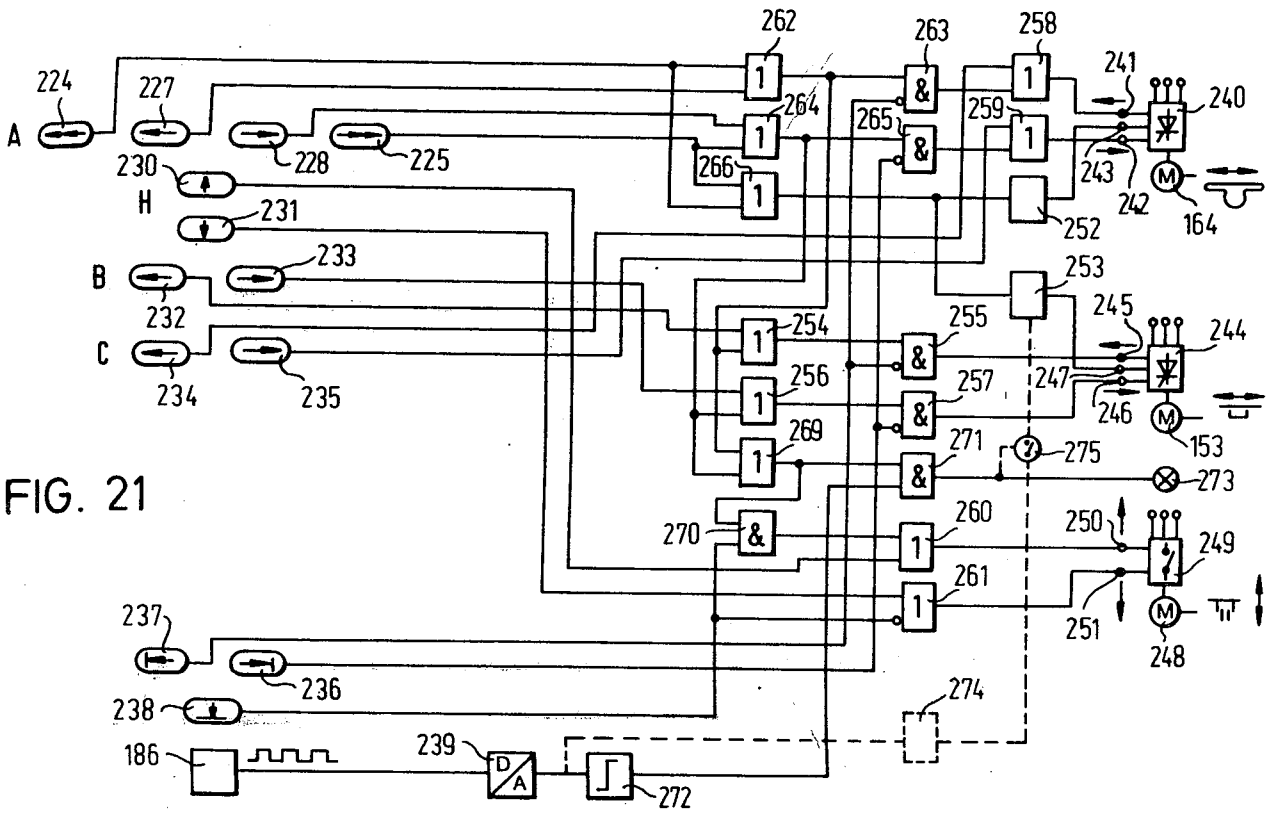
FIG. 21 shows a basic circuit diagram of the transfer apparatus, usable for several embodiments, especially the embodiment of FIGS. 7 and 8, which may be enlarged in accordance with requirements.

FIG. 21 shows a circuit diagram which is suitable for the control of the transfer apparatus as shown in FIGS. 7 and 8 but which could be adapted for use with the other embodiments described before by changes which will be referred to later. As an initial comment, it may be said that besides the parts shown it has a main on-and off switch for the power supply which accessible only by means of keys to authorized persons only, it has a replaceable fuse for said power supply and an emergency circuit breaker. These parts and their connection with the other parts of the control circuit are of conventional manufacture and are not shown.

The control circuit has manually operable contacts 226 to 235. The contacts 226 to 229 serve to move the platform 35 in the operational situation "A" with possibly a patient lying on said platform, effecting a drive of the lower apron 41 as well as of the conveyor apron 40, with the separator plates 37, 38. Activation of the contact 226 effects motion of the platform 35 to the left as seen from the service personnel, with high speed, and with the relatively lower speed whenever the contact 227 is closed. Correspondingly, in the operational situation "A", activation of the contact 228 brings about a motion to the right at low speed and an activation of the contact 229 a motion into the same direction at a higher speed. The contacts 230 (adjustment upward) and 231 (adjustment downward) are used for the vertical adjustment. Activation of the contacts 232, 233 in the operational situation "B" effects a motion of the platform 35 without simultaneously driving the conveyor apron 40 and the lower apron 41 in order to load or unload a patient. For reasons of safety a relatively slow motion of the platform 35 is the only one available for this operation. The same holds true for the operational situation "C", controllable by contact 234, 245 whereby the conveyor apron 40 and the lower apron 41 are moved to the left or to the right respectively, while the platform 35 is idle, in order to either correct the position of a patient recumbent on the platform 35 in relation to said platform, or in order to let the conveyor apron 40 and the lower apron 41 rotate during the disinfecting procedure.

Further, contact 236 of a switch 191 (FIGS. 12, 13) activated in one end position and contact 237 activated in another end position which has corresponding limit switch, are shown. As soon as the platform makes contact with any surface, switch 194 (FIG. 13) closes contact 238. The reflex light barrier 186 as shown in FIG. 12 with the impulse frequency of the speed of the conveyor apron 40 relative to the upper separator plate 37 provides a signal in the form of an impulse which by means of a subsequent digitizer 239 is translated into an analoguous signal directly proportional to the relative speed. The lower apron 41 and thus the conveyor apron 40 is driven by a motor 164 which receives its power by way of a thyristor switch 240 from the public current supply system; depending upon a load on input 241 or 242, one of the two rotational directions is obtained. The speed is controllable by means of an analog signal at the input 243 of the thyristor switch 240 by a phase angle control. In a corresponding manner, the motor 153 for the motion of the platform 35 is controlled by means of a thyristor switch 244 which has command inputs 245, 246 and a control input 247. The motor 248 for the vertical adjustment is activated in one of the two rotational directions by means of a mechanical switch 249 dependent upon the presence of a signal at input 250 or 251. An electronically controllable reference input 252 which loads the control input 243 of the thyristor switch 240 delivers a reference input in the absence of a signal which corresponds to the slow speed of the motor 164. If the reference input 252 is loaded with a signal, it produces a reference signal which effects a faster operation of the motor 164. In a corresponding manner, the reference input 253 parallel to the input of the reference input 252 in its quiescent state gives a reference signal to the input 247 of the thyristor switch 244 which effects a slow run of the motor 143, while the presence of an input signal at the reference input 253 increases the reference input and provides the motor 153 with greater effective voltage, resulting in a faster run.

If a signal for motion to the left of the platform 35 by means of contact 232 is given during the operational situation "B", i.e. while the conveyor apron 40 and the lower apron 41 are idle, this signal is loaded to the input of an OR-gate 254 which lets the signal pass through its output to a subsequent AND-gate 255 which has a non-inverting input. This AND-gate 255 may be loaded a turn-off signal at its inverting input, which signal may also come from contact 237. As long as the left final position has not yet been reached the contact 237 remains open, the turn-off signal not yet being effective, the AND-gate 255 letting the signal pass to the input 245 of the thyristor switch 244 which causes the motor 153 to be driven in the desired direction. When the final position has been reached, the contact 237 effects a turn-off signal, the AND-gate 255 locks and turns the drive off. In the same manner a signal given by contact 233 by way of an OR-gate 256 and an AND-gate 257 to the input 246 causes a motion towards the right until the contact 236 causes a turn-off signal which reaches the inverting input of the AND-gate 257 and locks it.

If, during the operational situation "C" only the lower apron 41 and with it the conveyor apron 40 are supposed to be driven — with the platform remaining idle — the contact 234 may be activated for the purpose of moving the carrying run 42 of the conveyor apron 40 to the left whereby the command signal passes an OR-gate 258 to the input 241 of the thyristor switch 240 and the motor 164 begins to operate in the desired rotational direction. In a corresponding manner, a command signal caused at contact 235 by way of an OR-gate 259 causes a signal load at the input 242 and thus the run of the motor 164 in the opposite rotational direction.

A command signal for the vertical adjustment upwards if given by means of contact 230 and goes by way of an OR-gate 260 to the input of switch 249. This activates the motor 248 in the respective rotational direction. Suitable mechanical means make sure that a vertical adjustment above a given top position is impossible while the motor 248 may continue to run. A descent is begun by the activation of the contact 231 which gives a command signal to the non-inverting input of an AND-gate 261. Its inverting input may be loaded a turn-off signal which may also come from contact 238. As long as this signal is not present the command signal continues to the input 251 of the switch 249 in order to activate the motor for a descent. When, however, the platform 35 touches upon another surface and a predetermined pressure is exerted upon the underside of the platform the contact 238 is activated, the turn-off signal created thereby locks the AND-gate 261 and the motor 248 is turned off.

During the operational situation "A", platform 35 as well as the conveyor apron 40 and the lower apron 41 are set in motion. The contact 266 for fast motion or the contact 277 for a slow motion produce a command signal which goes to an input of the OR-gate 262. In both cases a signal appears at its output which loads the input 241 by way of an AND-gate 263 and the OR-gate 258 and causes the activation of the motor 164 to drive the lower apron 41 in the required rotational direction on the one hand, and which, on the other, also goes to an input of the OR-gate 254 so that it effects the activation of the motor 153 and the motion of the platform 35 under the same conditions as the signal produced by contact 232. The AND-gate 255 as well as the AND-gate 263 are locked by the turn-off signal arriving at the inverting input which signal may be caused at the contact 237 so that the lower apron 41 and the conveyor apron 40 as well as the platform 35 come to a stop as soon as they reach their left end position. In a corresponding manner the command signals which may come from contacts 228, 229 may to to an OR-gate 264 which, in the presence of one of these command signals causes a signal at its output which, on the one hand, loads input 242 by way of an AND-gate 265 and the OR-gate 259 and turns the motor 164 on, while, on the other hand, it is taken to the OR-gate 256 and in this manner causes the motor 153 to be turned on under the same conditions as given by the command signal obtainable by contact 233. Here too both motors 164 and 153 are turned off as soon as the end position is reached since at that moment the contact 236 creates a turn-off signal and locks the AND-gate 265 as well as the AND-gate 257.

The command signal which may be caused by the contacts 226 and 229 do not only go to the input of the OR-gate 262 but also to the input of an OR-gate 266 whereby the latter causes an output signal shenever the faster speed is desired and loads the inputs of the control input 252, 253. Accordingly, in both motors 164, 153 their rotational speed is increased in both directions. It is an important feature that for safety reasons the faster rotational speed of the motor 153 and thus the faster motion of the platform 35 can be obtained only together with the faster rotational speed of the motor 164 and thus the faster run of the conveyor apron 40.

The reference signals as provided by the reference input controls 252, 253 for a slow or a fast run respectively must not necessarily be identical. As an illustration reference is made to FIG. 8. It may be assumed that the platform 35 has been moved into the position as drawn in solid lines in order to pick up a patient from a surface (not shown) situated below the level of the platform. The position of the longitudinal axis of the surface and thus of the patient recumbent upon it is indicated at 267 with a line drawn in dots and dashes; generally, the patient in FIG. 8 will probably lie to the right of line 267 and more towards the longitudinal side 57 (FIG. 7) of the platform 35. He thus is recumbent along a line which is at a distance from the mean axis of the platform 35 as indicated at line 268, which distance is at least half of the difference between the width of the platform 35 and the support 36. If the platform is subsequently moved to the opposite side of the support 36 and, for instance, into the position as indicated at 35''', the mean axis of the platform 35 is positioned as indicated by a line 268'. In order to unload the patient in the center of a new surface he would have to by lying in a position as indicated by a line 267' which in comparison to line 268' is equally distanced by at least half of the difference between the width of the platform 35 and the support 36, in this case towards the left. It is therefore a great advantage if, during the motion of the platform 35 and the simultaneous run of the conveyor apron 40 in the sense of the direction of its carrying run 42 and also into the sense into which the platform moves, the drive of the conveyor apron 40 in the direction of its carrying run 42 relative to the platform 35, is faster than the motion of the platform, by a at least a percentage which represents the relation between the width of the support and the width of the platform 35. These divergent speeds may be obtained by a suitable adjustment of the reference signals given by reference input controls 252, 253 for the slow as well as for the fast drive. The output of the OR-gates 262, 264 are connected to the input of an OR-gate 269 which gives a signal whenever a command is received by means of contacts 226 to 229 indicating the operational situation "A". This signal goes to the input of an AND-gate 270 whose other input may be loaded with a turn-off signal which may be caused by the contact 238 of the push switch 192 (FIG. 13). Whenever command signals for the motion of the platform 35 and the simultaneous drive of the conveyor apron 40 are present, the direction of its carrying run being the same into which the platform moves and when the signal produced by the contact 238 pf the switch 193 is present at the same time, the AND-gate 270 produces an output signal which reaches by way of the OR-gate 260 the input of the switch 249 and thus activates the vertical adjustment by means of the motor 248 for an upward motion until the turn-off signal of the contact 238 disappears. Damage to the underside of the platform 35 which at first still touches the underlying surface, is avoided because the platform is lifted simultaneously with its lateral motion. If so desired, a time element with a fall delay timer may be activated by the output signal of the AND-gate 270 to be connected between the latter and the OR-gate 260 which maintains the motor 248 operative during a pre-set delay beyond the disappearance of the turn-off signal given by the contact 238 in order to prevent even minimal pressure to the underside of the platform 35, which pressure may be too light to be measurable by the push switch 192. The output of the OR-gate 269 is also connected with an input of an AND-gate 271 whose other input may be loaded by the output signal of a threshold switch 272. The threshold switch 272 tops the digitizer 239 for the test signal in such a manner that, as soon as the relative speed between the conveyor apron 40 and the upper separator plate 37 reaches a pre-set level which corresponds to the threshold value of the switch 272 this switch produces an output signal. The AND-gate 271 produces an output signal each time the relative speed is unacceptably fast and whenever corresponding command signals are given in the operational situation "A" and are read as trouble signals by means of an indicator light 273. This light is most suitably installed next to the contacts 226 to 235 shown in FIG. 21 at the left, and, if desired, may also be utilized to indicate other irregularities.

It is possible to modify in many ways the circuit arrangement as shown in FIG. 21. The arrangement may be changed dependent upon the logic system used, for instance by a preferred utilization of NAND elements. An extension is equally possible in order to handle additional control functions adapted to different other embodiments of the transfer apparatus, as, for instance, for the swivelling of the platform 35 through the opening 31 in the embodiment as shown in FIGS. 5 and 6; suitable locking devices ensuring that certain operations may take place under particular conditions only, so for instance, a swivelling of the platform 35 through the opening 31 being possible only when the platform 35 is in its end position lying towards the pivot axis, and the glass panes 92, 93 are opened.

Another possible modification is indicated in FIG. 21. In this modification, dependent upon the test signal of a controlling means 274 topping the digitizer 239 the reference value of the reference control 253 is altered with an intention to keep the relative speeds between the conveyor apron 40 and the upper separator plate 37 constant whenever operational situation "A" is commanded and the relative speed does not exceed a threshold value pre-set by switch 272. The setting signal produced in this case by the controlling means 274 is loaded to the reference control 253 through a switch 275 controlled by an output signal of the AND-gate 271.

Another suitable variation consists in a possibility-probably for the embodiment as shown in FIGS. 19 and 20, dependent upon the presence of a command signal to move the platform 35, to activate the drive of the lower apron 41 in the running sense of its lower run 45 into the direction of the motion of the platform 35, the conveyor apron 40 remaining stationary. Appropriately the lower run 45 in this instance runs at a speed less than that of the motion of the platform 35. The purpose of this measure has already been stated in connection with FIG. 17. If, in this situation, the separator plates would be pulled from beneath a patient, the lower run 45 of the lower apron 41 would remain stationary with the supporting surface when driven by means of the non-modified control mechanism according to FIG. 21, in order to avoidfriction between the lower separator plate 38 and said surface. Should, however, the lower run 45 and the separator plates 37, 38 run towards the left in FIG. 17, the lower run 45 moving more slowly, possible folds of the bedsheets 217 would be smoothed and it is avoided with great certainty that these folds or folds of the clothing are caught in the crevice between the separator plates 37, 38.

In describing the operations of the control circuit according to FIG. 21 it is presupposed that the drive mechanisms for the platform 35 and for the conveyor apron 40 and the lower apron 41 are self-locking or that they are at least so tight that in a situation where the drive mechanism of the platform 35 is turned off, motion of the conveyor apron 40 and the lower apron 41 does not move the platform and vice versa. It is of course possible to provide braking devices for the platform 35 and/or for the coneyor apron 40 and the lower apron 41 to block these parts whenever their corresponding drive mechanism is disconnected. The control circuit may contain corresponding logic elements, as, for instance in the embodiment shown in FIG. 21.

Figure 22:
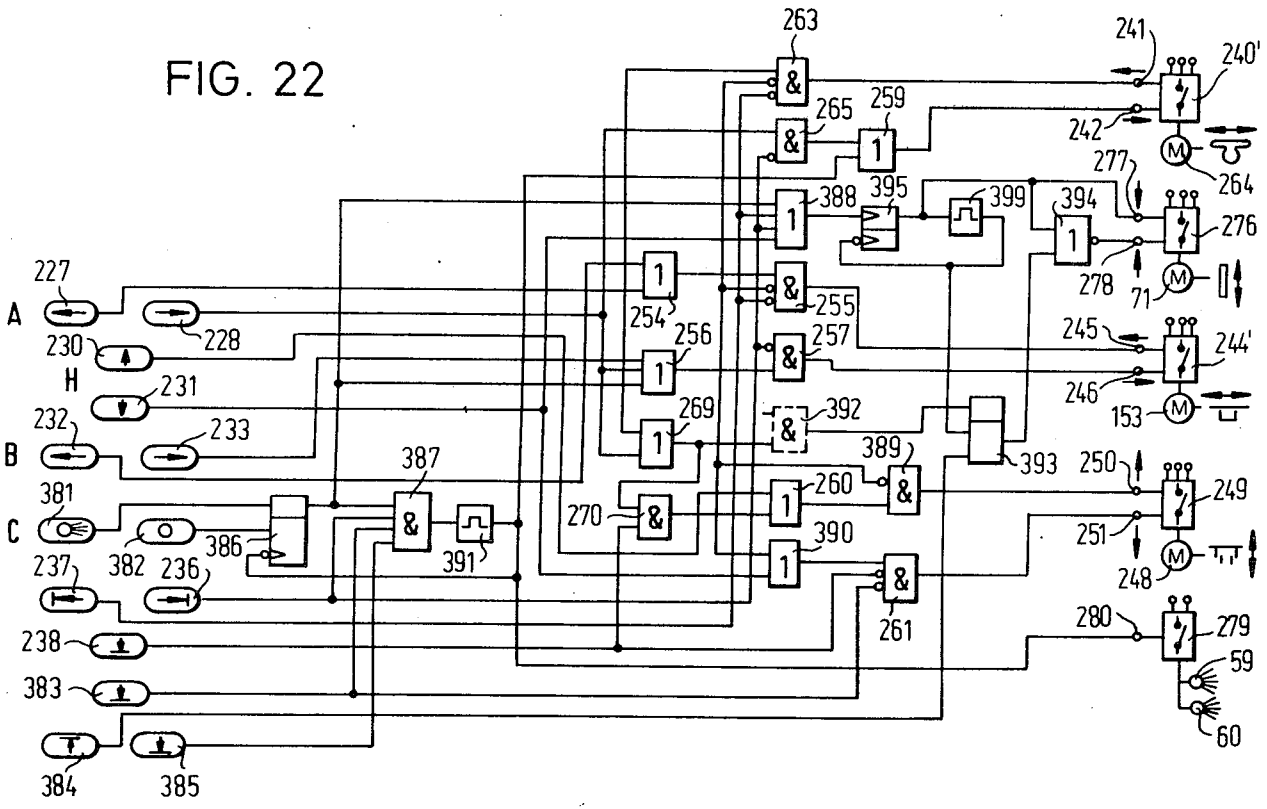
FIG. 22 shows a possible modified version of the circuit diagram of FIG. 21 for the control of the transfer apparatus of FIG. 2 and FIG. 3.

In some uses, a simplified version of the control circuit of FIG. 21 is possible. Thus the reflex-light-barrier 189, the digitizer 239, the threshold switch 272, the AND-gate 271 and the signal light 273 may be omitted for use with simpler embodiments. Also, for motion in the operational situation "A", a single speed may be provided which would make contacts 226 and 229, as well as elements 262, 264, 266, 252 and 253 superfluous, and simple switches could replace the thyristor switches 240, 244. In some embodiments it may not be necessary to drive the conveyor apron 40 and the lower apron 41 while the platform 35 is stationary, when used to adjust the position of a patient; and it may also suffice to provide a single running direction for the conveyor apron 40 and the lower apron 41 for the disinfecting procedure during the operational situation "C". FIG. 22 shows a control circuit as a variation of the one shown in FIG. 21 in which some of the aforementioned modifications have been considered and additional steps have been taken to control the transfer apparatus of FIGS. 2 and 3 with the glass pane 58 and the disinfecting devices 59, 60 (FIG. 1). Parts which correspond to FIG. 21 are referred to with the identical references symbols.

In FIG. 22 the contacts 226, 229 (FIG. 21) are missing and simple switches 240' and 244' are provided to control the motors 164, 153; the switches have inputs only 241, 242, and 245, 246 respectively. A switch 276 is shown which, dependent upon the presence of a signal at one of its inputs 278, 277 activates a gear motor 71 by an input signal for the purpose of lifting or lowering the glass pane 58. A further switch supplies the power for the disinfecting device 59, 60 when its input 280 receives an input signal.

Further, in the control circuit according to FIG. 22 a contact is used to replace contacts 234 235 (FIG. 21) to trigger a disinfecting cycle and a contact 382 is provided to interrupt the cycle if needed. Aside from these manually operated contacts 381, 382 a contact 383 of a switch located inside the telescopic base 67 (FIG. 3) - not shown - is provided which is activated whenever the telescopic base 67 together with the platform are in their bottom positions during a vertical adjustment, there also is a contact 384 of the switch 77 which is triggered by the glass pane 58 whenever it is in its uppermost end posittion at 58' (FIG. 3), the contact 385 being closed when the glass pane 58 has descended far enough that the disinfecting device 59 is in its operating position above the conveyor apron 40; the contact being, for instance, that of the switch 61 in FIG. 1.

Contact 281 is closed to start a disinfecting cycle. This contact is connected to the set input of a storage element 386 so that the closing of the contact sets this storage element 386. The signal which is thereby produced at its output goes to one input of an AND-gate 387, to an additional input of the OR-gate 265, to an additional inverting input of the AND-gate 263, to the input of an OR-gate 388. to an additional inverting input of the AND-gate 255, to an inverting input of an AND-gate 389 and to an input of an OR-gate 390. By loading the AND gates 263, 255, 389 with the output signal of the storage element 386, command signals which may have been given by way of the contacts 227, 232, 230 are cancelled which means that it is impossible to drive the motor 164 to move the carrying run 42 (FIG. 1) of the conveyor apron in FIGS. 2 and 3 to the left; that is is also impossible to drive the motor 153 to move the platform 35 towards the left and that it is equally impossible to drive the motor 248 to vertically adjust the platform 35 upwards. The output of the set storage element 386 by way of the OR-gate 256 however, effects an activation of thw motor o53 for a motion of the platform 35 towards the right, i.e. into the sterile area 34 in the same manner as an actuation of the contact 228 or the contact 233. Disconnection takes place in a manner already described whenever a right end position is reached where contact 236 is triggered, its output signal locking the AND-gate 257.

The output signal of the set storage element 386 and the OR-gate 390 which precedes the AND-gate 261 causes the motor 248 to be switched on to lower the platform 35. Unless in an emergency situation the platform makes contact with any surface or object which may not have been properly removed from its path, thus activating contact 238, it continues its descent until, in the bottom end position of the platform 35, it activates the contact 283; the output signal of contact 283 locks the AND-gate 261, which turns the motor 248 off.

The output signal of the set storage element 386 causes a descent of the glass pane by way of the OR-gate 388; the manner of its adjustment will be described further on. Its overall effect is that of bringing the platform 35 into its lowered position which lies essentially inside the sterile area 34 and of closing the opening 31 by the glass pane 58 before the disinfecting procedure (activation of the disinfecting devices 59, 60) begins. In this situation the contacts 236, 383 and 385 are activated. Only then all inputs of the AND-gate 387 have L-signals, so that an output signal is produced. A flip-flop 391 provided as a time element is flipped without delay and produces an output signal. This output signal is taken to the input 280 of the switch 279 so that the disinfecting devices 59, 60 are turned on. The output signal of the flipflop 391 also reaches the input of the OR-gate 259 thereby activating the motor 164 simultaneously with the switching on of the disinfecting devices 59, 60 in such a manner, that the carrying run (FIG. 1) of the conveyor apron 40 runs to the right in FIGS. 2 and 3. This particular running direction guarantees that at the end of the disinfecting time when the drive is turned off, all portions of the carrying run 42, 44 and the lower run 43, 55 of the conveyor apron 40 and the lower apron 41 subsequent to passing the disinfecting devices 59, 60 will not run through the relatively non-sterile area 33 again. It becomes thus impossible that bacteria which have settled on the conveyor apron 40 and the lower apron 41 in the comparatively non-sterile area 33 can be transferred into the sterile area 34 since they will have been killed by passing underneath the disinfecting devices 59, 60.

At the end of the disinfecting period the flip-flop 391 flips back into its original position and the trailing edge of the impulse returns the storage element 386 to its previous condition. The disappearance of the output signal of the flip-flop 391 turns the motor 164 off and also switches off the disinfecting devices 59, 60 and the re-setting of the storage element 386 causes its output signal to disappear, so that a control by means of all the contacts 227 to 233 is possible. If necessary, and because the transfer apparatus may be needed without delay for the transfer of another arriving patient, the disinfecting cycle may be interrupted by manipulation of contact 382 which also causes a re-setting of the storage element 386 as well as the flipping of the flip-flop 391 since it produces an output signal only in the presence of an input signal.

In the following, the control, of the vertical adjustment of the glass pane 58 is more closely described. This control is not done manually or by means of additional contacts but automatically depending on commands and turn-off signals stemming from the already described contacts.

The operational situation "A" where the platform 35 as well as the lower apron 41 and the conveyor apron 40 are driven is used primarily for a transfer, a patient being recumbent on the platform 35. Whenever activation of one of the contacts 227, 228 initiates the operational situation "A", the glass pane 58 is moved upwards to admit the patient lying on the platform 35. The existent OR-gate 269 produces an output signal whenever contact 227 or contact 228 are activated which output signal goes by way of a possibly provided AND-gate 392 to the setting input of a storage element 393. As soon as the latter is set, the L-signal present at its output in its non-set, qiescent state, disappears. This output is connected with an input of a NOR-gate 394. Its additional input lies at the normally non-signal producing output of another storage element 395 so that the NOR-gate 394 produces an output signal as soon as the storage element 393 is set. This signal goes to the input 278 of the switch 276, setting the motor 71 in motion to drive the glass pane 58 upwards. As soon as the glass pane 58 reaches its uppermost position as indicated at 58' in FIG. 3, the contact 384 of the switch is activated whereby the storage element 393 is set back. The signal then re-appearing at its output enforces an O-signal at the output of the NOR-gate 394, which turns off the motor 71.

If desired, an upward adjustment of the glass pane 58 may be prevented when there is no patient on the platform 35 and the platform is in the operational situation "A" and set in motion for other purposes, for instance if it is to be prepared for a loading operation. This may be achieved by a signal indicating the presence of a patient on the platform as soon as he is recumbent on its surface. As an example, one of the separator plates 37, 38 may contain strain gauges to meter the slight sagging of the platform 35 when a patient is placed upon it and the signal indicating his presence may be produced by a suitable evaluation circuit reacting to threshold values. The signal indicating a patient's presence is taken to the second input of the AND-gate 392 which is provided for this case. A setting of the storage element 393 is possible only if the operational situation "A" is initiated while the presence signal is given. It is in this constellation only that the motor 71 will be activated in order to move the glass pane 58 upwards.

As previously mentioned, a descent of the glass pane takes place whenever an output signal of the storage element 386 is present. A descent may also be triggered by the platform 35 during its horizontal motion reaching one of its end positions, which activates one of the contacts 236, 237, producing a turnoff signal. Finally, a descent of the glass pane 58 may be triggered by the activation of the contact 231 in order to lower the platform 35; in this position it may be assumed that the platform is near one of its endpositions in one of the areas 33, 34 and a loading or unloading operation is supposed to take place, during which the opening 31 may remain closed. In each of these instances one of the inputs of the OR-gate 388 receives a signal whereby the leading edge of the signal produced at its output sets the storage element 395. By this, the latter produces at its output an L-signal which goes to the control input 277 of the switch 276, setting the motor 71 in motion to move the glass pane 58 downwards.

The output of the storage element 395 is also connected to the input of a monostable flip-flop 396 provided as a time element which produces an output impulse during a pre-set delay. This delay is chosen in such a manner that during its duration the glass pane 58 may be moved from its uppermost position into its absolute bottom position with a fully descended platform 35. After the expiration of the delay time the trailing edge of the impulse created by the flip-flop 396 sets the storage element 395 back. In this manner, the motor 71 isturned off. This happens even when the platform 35 is in one of its end positions horizontally where one of the contacts 236, 237 is activated since the storage element 395 may be set only by the leading edges of thesignals to be produced by the OR-gate 388. In order that during the descent of the glass pane 58 the storage element 393 may not be set, which would trigger an upward motion immediately after completion of the descent. the storage element 393 is kept in a re-set condition during the descent by the output signal of the flip-flop 396.

A control of the drive mechanism for the glass pane in the described manner causes the opening 31 to be opened only when required and only as long as needed in order to prevent as far a possible a transfer of bacteria through said opening. It serves thisvery same purpose when the glass pane 58 - at least when it is being closed (in the embodiment shown also when it is being raised) with a speed greater than that of the height adjustment of the platform 35.

The greater speed of the glass pane 58 during its descent and relative to the descending motion of the platform 35 causes the glass pane 58 to touch the platform with its lower end or with the disinfecting device 59 before the platform 35 has reached its bottom position. This does not turn off the motor 71 by activation of the contact 385, which motor keeps running during the delay time pre-determined by the flip-flop 396, the glass pane 58 following the slower descending motion of the platform by virtue of the effect of the overrunning clutch 73. This makes it evident that the delay time of the flip-flop 396 has to be greater than the span of time needed for the glass pane 58 to move from its uppermost position to its bottom position, provided its descent is not hindered. Because the motor 71 may be turned off only when the platform 35 has reached its bottom position, the delay time of the flip-flop 396 must be at least as long as the time needed to move the platform during its vertical adjustment from its uppermost position to its bottom position; and in order to avoid any superfluous operation of the motor 71 the delay time of the flip-flop 396 appropriately corresponds to the maximum vertical adjustment time of the platform 35.

FIGS. 21 and 22 show no means to prevent irregularities caused by the simultaneous activation of contacts causing opposite effects as, for instance, the activation of the contacts 227 and 228, or the contacts 228 and 232. Suitably, theswitches 240, 244, 249 in FIG. 21 are so constructed that they are inoperable whenever input signals are present at both inputs.

If necessary, additional electrical or mechanical locking mechanisms may prevent a break-down in such an instance.

A modification of the control circuit of FIG. 22 for use with the transfer apparatus of FIGS. 5 and 6 is easily possible. As an example, the output of the storage element 386 could be connected with an additional input of the OR-gate 254 instead of with the OR-gate 256 in order to first obtain the motion of the platform 35 into the end position lying towards the swivel axis as shown in FIG. 5 and the AND-gate 387 besides its input which is connected to the storage element 286 merely needs another input connected to the contact 237, so that the disinfecting procedure may begin as soon as the above mentioned end position is reached by the platform. In the same manner as with the use of thecontrol circuit of FIG. 22 in connection with the transfer apparatus of FIGS. 2 and 3 it is thus ascertained that the disinfecting time is always exactly adhered to and is not shortened by a possible precipituous motion of the platform 35.

It is possible without great difficulty to adapt the control circuit of FIGS. 21 or 22 for use with a transfer apparatus as shown in FIGS. 19 and 20. In most cases, the motor 281 instead of the motor 153 must be put into operation, driving only the disinfecting cycle and only during the slow drive of the lower apron 41; in the operational situation "B" the added use of the motor 153 being required.

We claim:

1. Apparatus for transferring recumbent patients, particularly in hospitals, comprising a platform assembly including frame means consisting of an upper and a lower frame element arranged to form said platform assembly in a horizontally disposed rectangular configuration consisting of superposed upper and lower planer platform members; an upper conveyor apron shaped as an endless belt trained about said upper frame element and arranged as part of said upper platform member; a lower apron trained about said lower frame element and arranged as part of said lower platform member; said upper and lower conveyor aprons being disposed to extend parallel to each other between said upper and lower frame elements with the portion of said upper conveyor apron extending over said upper frame element defining a surface for said platform assembly whereupon a recumbent patient may be received; a main support member having said platform assembly movably supported thereon; drive means located within said main support member and including means for horizontally shifting said platform assembly relative to said main support member; lateral cheek members connected with said frame means and extending along the sides of said platform assembly in directions parallel to the directions of movement of said assembly; and guide means mounted upon said main support member and located on opposite sides thereof, said guide means engaging said lateral cheek members to guide movement of said platform assembly within a horizontal transfer plane extending to opposite sides of said main support member; said guide means and said lateral cheek members being constructed to enable movement of said platform assembly within said horizontal transfer plane between two opposed end positions of movement located generally equidistantly on opposite sides of said main support member, said horizontal transfer plane being thereby defined to extend generally symmetrically relative to said main support member.

2. Apparatus according to claim 1 wherein said drive means include means for moving said lower apron relative to said lower frame means independently of the movement of said platform assembly.

3. Apparatus according to claim 1 wherein said main support member is formed with a width dimension taken parallel to the direction of movement of said platform assembly which is less than one-half the width dimension of said platform assembly taken in a direction parallel thereto.

4. Apparatus according to claim 3 wherein said width of said main support member is within the range between one-third and one-sixth of said width of said platform assembly.

5. Apparatus according to claim 1 wherein said lateral cheek members stand upwardly above the surface of said plate assembly by an amount greater than their total thickness.

6. Apparatus according to claim 1 wherein said lateral cheek members have formed therein channels located in the opper portions thereof, said guide means including rollers interacting with said channels, said rollers being mounted upon said main support member.

7. Apparatus according to claim 1 wherein said drive means include means for driving said lower conveyor apron, said lower apron drive means including a barrel drive provided within said main support member and arranged at right angles to the direction of movement of said aprons, said lower apron including a lower run which is looped about said barrel drive, said lower apron drive means further including two deflector rollers provided within said main support member and extending across the width of said lower apron perpendicularly to the running direction of said aprons, said deflector rollers being located beneath said frame means, said deflector rollers being spaced apart a distance smaller than the diameter of said barrel drive and having the lower run of said lower apron deflected thereabout into the direction of the barrel drive.

8. Apparatus according to claim 7 wherein said deflector rollers are arranged below said lower frame element, said deflector rollers including outer portions which are a small distance from said lower frame element approximately corresponding to the thickness of said lower apron.

9. Apparatus according to claim 1 wherein said upper conveyor apron comprises an upper run and a lower run, said upper run being said portion defining said surface for receiving thereon recumbent patients, said lower conveyor apron also comprising a lower run and an upper run, said upper run of said lower conveyor apron extending generally parallel to said lower run of said upper conveyor apron between said upper and lower frame elements of said frame means, said aprons being arranged such that said upper conveyor apron is driven by engagement of its lower run with said upper run of said lower apron.

10. Apparatus according to claim 9 wherein said lower run of said upper conveyor apron is driven by frictional contact with the upper run of said lower conveyor apron.

11. Apparatus according to claim 9 further comprising rotating drive elements engaged with the edges of said upper conveyor apron for driving said apron, said elements being journaled in said lateral cheek members, a profile shaft having its ends in gear with said rotating drive elements, said profile shaft being unsupported between said ends in said lateral cheek members and extending along nearly their entire length, the profile shaft being non-rotatably and axially moveable, and a drive wheel held stationary in one frontal side of said support member, said profile shaft traversing said drive wheel which is provided as part of said drive means located in said support member.

12. Apparatus according to claim 1 wherein said drive means include a drive mechanism for said platform assembly, a drive mechanism for said lower apron and a drive mechanism for said upper apron, said drive mechanisms being self-locking.

13. Apparatus according to claim 1 wherein said drive means include means for driving said upper conveyor apron, said drive means being responsive to signals for effecting shifting movement of said platform and simultaneous activation of said upper conveyor apron in order to move said upper portion of said upper conveyor apron in the direction of motion of said platform assembly, said conveyor apron being activated in such a manner that the advance of its upper portion is relatively faster than a shifting motion of said platform assembly.

14. Apparatus according to claim 13 wherein said motion of said upper portion of said upper conveyor apron is faster than the motion of said platform by a percentage equivalent to the relationship of the width of said support member to the width of said platform assembly.

15. Apparatus according to claim 13 wherein said drive means include means for driving said lower conveyor apron, and wherein dependent upon the presence of a signal for effecting shifting motion of said platform assembly while said upper conveyor apron is held stationary, said drive means for said lower conveyor apron in order to move a lower run of said apron in the direction of motion of said platform assembly operate to be activated with a running speed which is less than that of the moving speed of the platform assembly.

16. Apparatus according to claim 1 wherein said drive means include means for driving said upper conveyor apron, said apparatus further including a metering device and means for controlling the movement of said upper portion of said upper conveyor apron relative to said platform assembly in response to a test signal produced by said metering device.

17. Apparatus according to claim 1 further comprising a motorized vertical adjustment mechanism for vertically moving said platform assembly, and means arranged in proximity to the longitudinal edges of said frame means, said means producing a signal whenever pressure is applied to the underside of said platform assembly, the presence of said signal causing said vertical adjustment mechanism to be disabled during a descending operation.

18. Apparatus according to claim 1 wherein said upper and lower frame elements comprise separator plates having along their longitudinal edges ledges fixed to said separator plates.

19. Apparatus according to claim 18 wherein said upper separator plate consists of two plate sectors moveable against each other and parallel to the plane of said separator plate, one of said sectors being connected to the lower separator plate and to said lateral cheek members.

20. Apparatus according to claim 1, said apparatus being located to extend through an opening in a wall separating a sterile area from a relatively non-sterile area and for transferring patients therebetween, said opening including a vertically adjustable wall closure element, said main support member including longitudinal sides located flush with the outside of said wall, said opening including a lower edge corresponding approximately to the length of said main support member, said platform assembly being arranged with said upper and lower conveyor aprons positioned to be moved in directions perpendicularly to said wall defining said opening, said wall closure element being controlled by means of a self-locking gear motor, and overrunning clutch and at least one friction roller arranged to be in contact with said wall closure element.

21. Apparatus according to claim 20 wherein said motor includes activation means responsive to horizontal motion of said platform assembly operating in conjunction with a signal indicating the presence of a patient upon said platform assembly, and wherein activation of said motor in the rotational direction required for lifting said wall closure element occurs in response to the presence of said signal.

22. Apparatus according to claim 21 including at least one disinfecting device located at right angles to the direction of movement of said conveyor aprons and extending across the entire width of said aprons to disinfect both said upper and lower conveyor aprons.

23. Apparatus according to claim 20 wherein there is provided disinfecting means including a disinfecting device provided at the bottom of said moveable wall closure element facing downwardly toward said upper conveyor apron and another disinfecting device provided within said support member facing upwardly toward said lower conveyor apron.

24. Apparatus according to claim 20 wherein said platform assembly when in one of its two opposed end positions is located to be virtually entirely within said sterile area.

25. Apparatus according to claim 20 further including a storage element adaptable to emit an output signal to control movement of said upper and lower conveyor aprons, said conveyor aprons being operated so that depending upon said output signal said upper conveyor apron and said lower conveyor apron are moveable in negative correlation of their running directions such that the upper run of said upper conveyor apron moves from said relatively non-sterile area toward said sterile area.

26. Apparatus according to claim 1 wherein said apparatus is located to transfer patients between a sterile area and a relatively non-sterile area separated by a wall having an opening therein, with said apparatus being arranged to transfer patients through said opening from one side of said wall to the other, said opening being closeable by means of two wall closure elements moveable in opposite directions, said support member of said platform assembly being supported upon a swivel arm extending parallel to the running direction of said aprons and located pivotably about a virtical pivot axis in proximity to one side of said opening, the length of said swivel arm between the pivot axis and a longitudinal side of said support member being at least equal to the difference between the width of said platform assembly and the width of said support member.

27. Apparatus according to claim 26 further including a disinfecting device fixed upon said support member at an elevation equivalent to the elevation of said frame means and at a distance from a longitudinal side of said support member facing said pivot axis which corresponds to the difference between the width of said platform assembly and the width of said support member.

28. Apparatus according to claim 1 further comprising a moveable chassis having said support member mounted thereon, said chassis being moveable against said support member at least approximately parallel to the direction of motion of said platform assembly, said drive means operating to effect movement of said chassis against said support member simultaneously and in the same sense of motion as said platform assembly.

29. Apparatus according to claim 28 wherein said chassis comprises two casters each fastened in proximity to a frontal side of said support member and beneath said support member being pivotable about a vertical pivot axis, two horizontally arranged angled sections of approximately equal length arranged at right angles to each other, and a total of four casters affixed to the outer ends of legs of said angled sections, said casters being pivotable about a vertical axis, the angular sections each being pivotally fastened close to the frontal sides of said support member and beneath said support member to be pivotable about a pivot axis coinciding with each one of the pivot axes of said casters.

30. Apparatus according to claim 29 wherein said angular sections are arranged such that the swivel area thereof is limited to 90° in such a manner that at each end position one leg is parallel to and the respective other leg is at right angles to the running sense of said conveyor aprons.

* * * * *